US009809408B2

(12) United States Patent
Maenishi et al.

(10) Patent No.: US 9,809,408 B2
(45) Date of Patent: Nov. 7, 2017

(54) SHEET PROCESSING APPARATUS EQUIPPED WITH LATERAL DISPLACEMENT CORRECTION FUNCTION

(71) Applicant: CANON KABUSHIKI KAISHA, Tokyo (JP)

(72) Inventors: Hiromasa Maenishi, Matsudo (JP); Mitsuhiko Sato, Kashiwa (JP); Takashi Yokoya, Yoshikawa (JP); Yutaka Ando, Toride (JP); Akihiro Arai, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/152,787

(22) Filed: May 12, 2016

(65) Prior Publication Data

US 2016/0340143 A1 Nov. 24, 2016

(30) Foreign Application Priority Data

May 19, 2015 (JP) ..... 2015-101779

(51) Int. Cl.
*B65H 31/20* (2006.01)
*B65H 31/10* (2006.01)
(Continued)

(52) U.S. Cl.
CPC ..... *B65H 31/20* (2013.01); *B65H 31/10* (2013.01); *B65H 31/38* (2013.01);
(Continued)

(58) Field of Classification Search
CPC ..... B65H 31/20; B65H 31/34; B65H 31/38; B65H 31/10; B65H 2601/2525;
(Continued)

(56) References Cited

U.S. PATENT DOCUMENTS

2011/0229237 A1* 9/2011 Hayashi ..... B65H 3/44 400/76
2012/0146279 A1* 6/2012 Furuhashi ..... B42C 1/125 270/58.16

(Continued)

FOREIGN PATENT DOCUMENTS

JP 2006206331 A 8/2006

*Primary Examiner* — David H Bollinger
(74) *Attorney, Agent, or Firm* — Rossi, Kimms & McDowell LLP

(57) ABSTRACT

A sheet processing apparatus capable of discharging even a lateral displacement uncorrectable sheet onto a discharge tray without collision with an alignment plate. A finisher conveys a sheet along a conveying path. A shift unit corrects a lateral displacement of the sheet based on a result of detection by a lateral displacement detection sensor. Sheets discharged via the conveying path are stacked on a discharge tray. A pair of alignment plates disposed above the stacking tray are lowered and are moved between a standby position and an alignment position to be brought into abutment with respective opposite edges of the discharged sheet in the alignment position. A finisher controller makes a distance between the alignment plates in a standby position different according to a sheet type, even when a size of the sheet in the width direction is the same.

11 Claims, 16 Drawing Sheets

(51) Int. Cl.
*B65H 31/38* (2006.01)
*G03G 15/00* (2006.01)

(52) U.S. Cl.
CPC ..... *G03G 15/6552* (2013.01); *B65H 2511/12* (2013.01); *B65H 2511/22* (2013.01); *B65H 2601/2525* (2013.01); *B65H 2801/06* (2013.01); *G03G 2215/00497* (2013.01); *G03G 2215/00911* (2013.01)

(58) Field of Classification Search
CPC ..... B65H 2511/12; B65H 2511/22; B65H 2801/06; G03G 15/6552; G03G 2215/00447; G03G 2215/00556; G03G 2215/00717
See application file for complete search history.

(56) References Cited

U.S. PATENT DOCUMENTS

2012/0153556 A1* 6/2012 Sugiyama ..... B65H 31/3081 270/58.08
2012/0282004 A1* 11/2012 Furuhashi ..... B65H 31/38 399/408
2013/0228965 A1* 9/2013 Hoshino ..... B65H 29/246 271/211
2014/0125001 A1* 5/2014 Fukuda ..... B65H 31/10 270/58.31
2014/0159301 A1* 6/2014 Suzuki ..... B65H 31/26 271/220
2014/0159304 A1* 6/2014 Masuyama ..... G03G 15/6552 271/227

* cited by examiner

ALIGNMENT POSITION

RETRACTED POSITION

SHEET PROCESSING APPARATUS EQUIPPED WITH LATERAL DISPLACEMENT CORRECTION FUNCTION

BACKGROUND OF THE INVENTION

Field of the Invention

The present invention relates to a sheet processing apparatus equipped with a lateral displacement correction unit for correcting displacement of a sheet in a width direction orthogonal to a conveying direction.

Description of the Related Art

Conventionally, as an apparatus provided in an image forming system including a printer, a copying machine, a facsimile machine, and so forth, there has been known a sheet processing apparatus equipped with a shift function for shifting a position of every set number of sheets in a width direction orthogonal to a conveying direction to thereby discharge and stack each sheet at a corresponding position on a discharge tray. The sheet processing apparatus equipped with the shift function is required to cause bundles of sheets sorted by the shift function to be stacked on the discharge tray such that the sheets of each bundle are accurately aligned.

As such a sheet processing apparatus, there has been known one in which alignment plates are retracted upward from a discharge tray, and the alignment plates are lowered to a position of a sheet bundle according to the timing of the discharge of sheets onto a discharge tray to thereby align the sheets of each bundle (see e.g. Japanese Patent Laid-Open Publication No. 2006-206331).

However, the above-described prior art suffers from a problem that if a lateral displacement (positional shift in a width direction) of a sheet conveyed from an upstream apparatus is large, the sheet is brought into collision with the alignment plates when it is to be stacked on the discharge tray, which causes degradation of sheet alignment and the quality of a sheet bundle.

FIGS. 16A to 16C are views useful in explaining the problem with the prior art. FIGS. 16A and 16C are views of the discharge tray, as viewed from above, and FIG. 16B is a view of the same, as viewed in a sheet discharging direction.

In general, in a sheet processing apparatus, before sheets P having a predetermined sheet width Z are discharged, a distance between alignment plates 202*a* and 202*b* is increased, and in this state, the alignment plates 202*a* and 202*b* are held on standby in respective positions each spaced from an associated side edge of each sheet P assumed to have been discharged, by a predetermined distance X. Then, the sheet P is discharged onto a discharge tray 201 with the alignment plates 202*a* and 202*b* held in a state spaced from the respective side edges of the sheet by the predetermined distance X. Further, in the sheet processing apparatus, in a case where the center of the currently conveyed sheet P in a width direction orthogonal to a conveying direction (see FIG. 16B) suffers from displacement from an assumed center position of conveyance (see FIG. 16A), the displacement is corrected beforehand by a lateral displacement correction unit.

However, a sheet of a type, such as an OHP sheet, a translucent vellum sheet, or a sheet of a size smaller than A5R, which is not subjected to the lateral displacement correction, is discharged onto the discharge tray without correction of the lateral displacement thereof. For this reason, in a case where a sheet, for which lateral displacement correction cannot be performed, is conveyed from an upstream apparatus, with a large lateral displacement, the sheet sometimes collides with the alignment plate 202*a* or 202*b* when discharged onto the discharge tray 201, as shown in FIG. 16C. When the sheet is brought into collision with the alignment plate, the orientation of the sheet changes. This degrades sheet alignment and the quality of a sheet bundle, and sometimes causes a jam.

SUMMARY OF THE INVENTION

The present invention provides a sheet processing apparatus which makes it possible to discharge even a sheet of a type for which lateral displacement correction is not performed onto a discharge tray without bringing the sheet into collision with an alignment plate, to thereby improve sheet alignment and the quality of a sheet bundle.

The invention provides a sheet processing apparatus comprising a conveying unit configured to convey a sheet along a conveying path, a detection unit provided in the conveying path and configured to detect a position of the sheet in a width direction orthogonal to a conveying direction, a correction unit configured to correct the position of the sheet in the width direction based on a result of detection by the detection unit, a stacking unit configured to stack sheets discharged via the conveying path, an alignment unit disposed above the stacking unit and including a pair of alignment members which are moved in the width direction, the alignment unit being configured to bring the pair of alignment members into contact with opposite edges of a sheet having been discharged to thereby align the sheet, an acquisition unit configured to acquire a type of a sheet, and a control unit configured to control the alignment unit such that a distance between the pair of alignment members in a standby position is made different according to the sheet type acquired by the acquisition unit, even when a size of the sheet in the width direction is the same.

According to the invention, when a sheet of a type for which the correction unit does not perform lateral displacement correction is to be discharged, the distance between the alignment members in the standby position is set larger than when a sheet of a type that permits lateral displacement correction is to be discharged. This makes it possible to cause even sheets of the type for which lateral displacement correction is not performed to be discharged onto the discharge tray without collision with either of the alignment members and be stacked thereon in an aligned manner. Therefore it is possible to improve sheet alignment and the quality of a sheet bundle.

Further features of the present invention will become apparent from the following description of exemplary embodiments (with reference to the attached drawings).

DESCRIPTION OF THE EMBODIMENTS

The present invention will now be described in detail below with reference to the accompanying drawings showing embodiments thereof.

Figure 1:
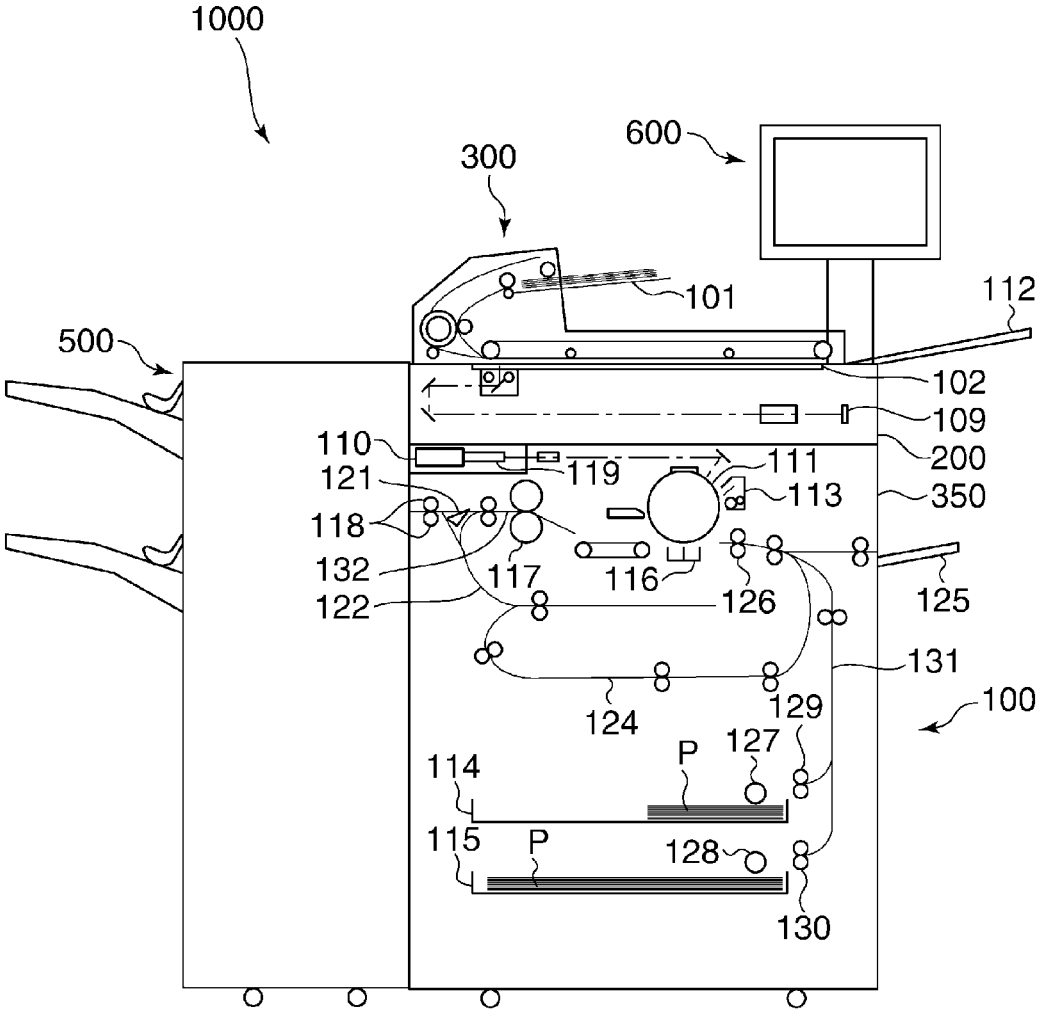
FIG. 1 is a schematic longitudinal cross-sectional view of an image forming apparatus in an image forming system provided with a sheet processing apparatus according to an embodiment of the invention.

FIG. 1 is a schematic longitudinal cross-sectional view of an image forming apparatus in an image forming system provided with a sheet processing apparatus according to an embodiment of the invention.

Referring to FIG. 1, the image forming system 1000 is basically comprised of the image forming apparatus, denoted by reference numeral 100, the sheet processing apparatus (finisher), denoted by reference numeral 500, and a console unit 600. The image forming apparatus 100 is comprised of an image reading device (image reader) 200 that reads an original, a document feeder 300 that feeds an original to the image reader 200, and a printer 350 that forms an image on a sheet based on image data.

The document feeder 300 is comprised of an original tray 101, a platen glass 102, and a discharge tray 112. For example, the document feeder 300 feeds originals set on the original tray 101 with their front surfaces facing upward, one by one, starting with the leading page, in a leftward direction as viewed in FIG. 1, such that each original is guided along a curved path, then conveyed on the platen glass 102 from the left through an original reading position to the right, and discharged onto the discharge tray 112.

The image reader 200 reads an original by an image sensor 109 while the original is passing a predetermined image reading position on the platen glass 102 from the left to the right as viewed in FIG. 1. The image reader 200 outputs an image read by the image sensor 109 as a video signal to an exposure device in the printer 350.

Next, a description will be given of the configuration of the printer 350.

The printer 350 is comprised of an image forming section, a conveying path along which a sheet P as a recording sheet is conveyed to the image forming section, and a sheet storage section for storing sheets P. The image forming section is comprised of a photosensitive member 111 as an image bearing member, an exposure device 110 disposed in a manner opposed to the photosensitive member 111 and provided with a polygon mirror 119, and a developing device 113. The sheet storage section is comprised of an upper cassette 114, a lower cassette 115, and a manual sheet feeder 125. The conveying path includes a supply path 131 along which a sheet P is conveyed from the upper or lower cassette 114 or 115 to a transfer section 116 of the photosensitive member 111 and a discharge path 132 along which the sheet P having an image formed thereon is conveyed through a fixing device 117 so as to be discharged out of the image forming apparatus 100. An inversion path 122 is connected to the discharge path 132 at a location downstream of the fixing device 117, and a double-sided conveying path 124 is connected to the inversion path 122.

On the supply path 131, there are provided pickup rollers 127 and 128 and feed roller pairs 129 and 130 associated with the respective upper and lower cassettes 114 and 115, and a registration roller pair 126. On the discharge path 132, there are provided a flapper 121 disposed at a point downstream of the fixing device 117 where the inversion path 122 branches from the discharge path 132, and a discharge roller pair 118 for discharging the sheet P toward the downstream finisher 500.

In the printer 350 configured as above, the exposure device 110 modulates a laser beam based on the video signal input from the image reader 200 and forms an electrostatic latent image corresponding to the video signal by scanning the surface of the photosensitive member 111 with light, using the polygon mirror 119. The developing device 113 supplies toner as a developer to the electrostatic latent image formed on the photosensitive member 111, whereby the electrostatic latent image is visualized as a toner image.

On the other hand, the sheet P fed from the sheet storage section is conveyed to the registration roller pair 126 at rest by the feed roller 129 or 130 and the like. The leading edge of the sheet P is brought into abutment with the registration roller pair 126 and stops, and then the registration roller pair 126 conveys the sheet P to the transfer section 116 of the photosensitive member 111 in timing synchronous with the start of laser beam irradiation. The toner image formed on the photosensitive member 111 is transferred onto the sheet P by the transfer section 116. The sheet P having the toner image transferred thereon is conveyed into the fixing device 117, and is heated and pressed by the fixing device 117, whereby the toner image is fixed onto the sheet P. The sheet P having passed through the fixing device 117 is discharged toward the finisher 500 via the flapper 121 and the discharge roller pair 118.

When the sheet P is to be discharged face-down, i.e. with an image-formed surface thereof facing downward, the sheet P having passed through the fixing device 117 is once guided into the inversion path 122 by a switching operation of the flapper 121. Then, after the trailing edge of the sheet P has left the flapper 121, the sheet P is switched back to be discharged from the printer 350 by the discharge roller pair 118.

On the other hand, in the case of double-sided printing in which images are formed on both sides of a sheet P, the sheet P having an image formed on a first side thereof is guided into the inversion path 122 by the switching operation of the flapper 121, and is then switched back to be further conveyed to the double-sided conveying path 124. Then, the sheet P is conveyed from the double-sided conveying path 124 to the transfer section 116 of the photosensitive member 111 again in predetermined timing, followed by an image being formed on a second side of the sheet P.

Figure 2:
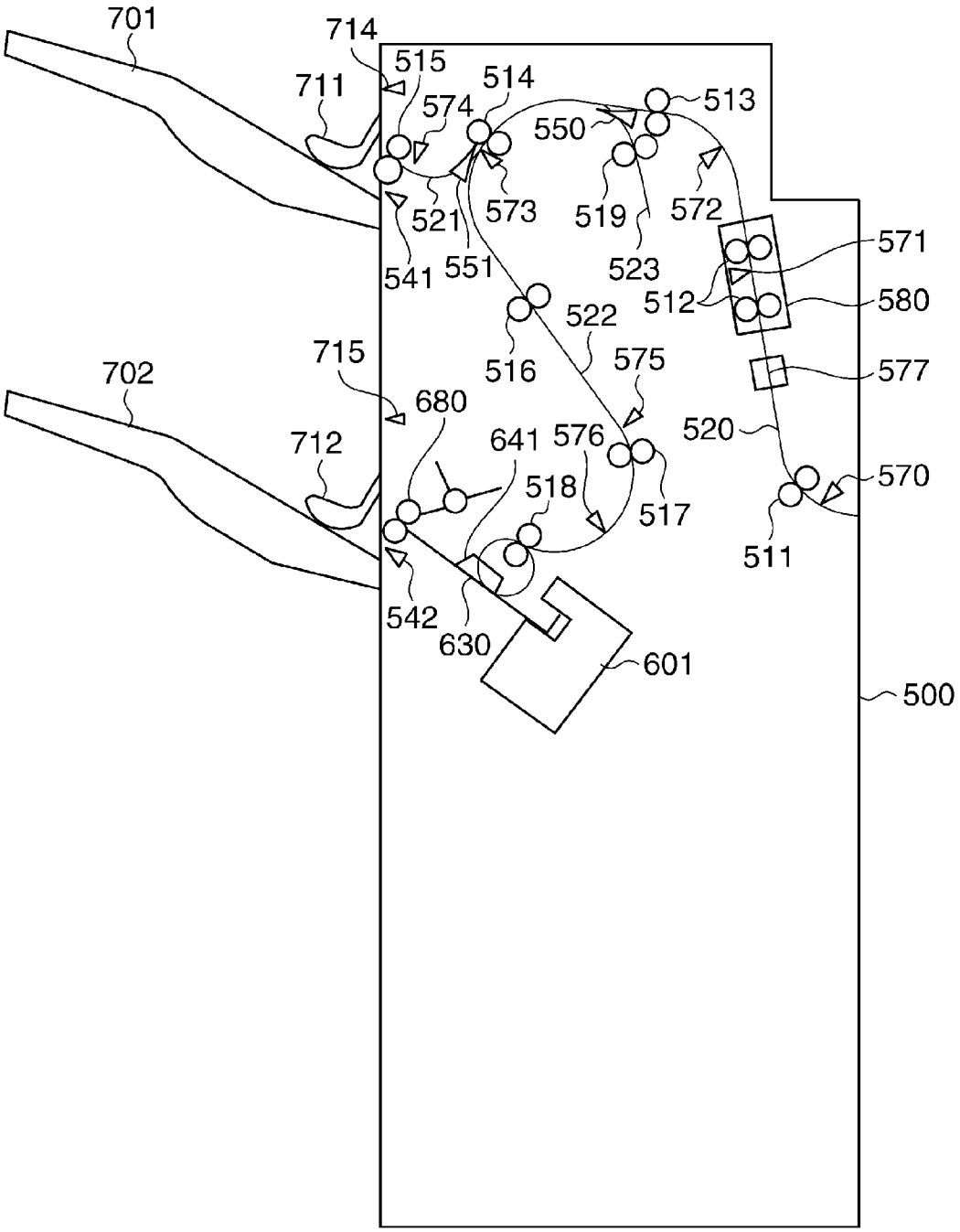
FIG. 2 is a schematic longitudinal cross-sectional view of a finisher appearing in FIG. 1.

Next, a description will be given of the configuration of the finisher 500. FIG. 2 is a schematic longitudinal cross-sectional view of the finisher 500 appearing in FIG. 1.

Referring to FIG. 2, the finisher 500 has a conveying path as conveyance passages for conveying sheets P discharged from the image forming apparatus 100 to an upper discharge tray 701 or a lower discharge tray 702 while performing various processing on the sheets P as required. More specifically, the conveying path of the finisher 500 includes a conveying path 520 as a conveyance passage along which a sheet P received from the image forming apparatus 100 is conveyed to a conveying roller pair 514 located upstream of the upper discharge tray 701 via a shift unit 580, an upper discharge path 521 along which a sheet P conveyed to the conveying roller pair 514 is conveyed to the upper discharge tray 701, and a lower discharge path 522 along which a sheet P conveyed to the conveying roller pair 514 is conveyed to a processing tray 630.

On the conveying path 520, there are arranged a conveyance sensor 570, a conveying roller pair 511, and the shift unit 580, along the conveying direction of a sheet P. A lateral displacement detection sensor 577 disposed upstream of the shift unit 580 detects a lateral position of a sheet P as a position of a side edge thereof in a direction orthogonal to the conveying direction, and the shift unit 580 corrects the lateral position of the sheet P. The shift unit 580 is provided with first and second conveying roller pairs 512, and a conveyance sensor 571 is disposed between the first and second conveying roller pairs 512.

At a location downstream of the shift unit 580, there are disposed a conveyance sensor 572 and a conveying roller pair 513, and a buffer path 523 provided with a conveying roller pair 519 branches from the conveying path 520 at a location downstream of the conveying roller pair 513. At a point of branching of the buffer path 523, there is disposed a flapper 550. The flapper 550 guides a sheet reversely conveyed by the conveying roller pair 514 into the buffer path 523.

The conveying path 520 branches into the upper discharge path 521 and the lower discharge path 522 at a location downstream of the point of branching of the buffer path 523. At a point of branching of the upper discharge path 521 and the lower discharge path 522, there is disposed a flapper 551. On the upper discharge path 521 extending from the flapper 551 to the upper discharge tray 701, there are provided a discharge sensor 574 and a conveying roller pair 515. On the lower discharge path 522 extending from the flapper 551 to the processing tray 630, there are provided conveying roller pairs 516, 517, and 518 and conveyance sensors 575 and 576. The processing tray 630 is provided with a stapler 601 and an alignment member 641, and a conveying path downstream of the processing tray 630 extends to the lower discharge tray 702. On the conveying path downstream of the processing tray 630, there is provided a bundle discharge roller pair 680.

The finisher 500 configured as above sequentially takes in sheets P discharged from the image forming apparatus 100 and performs various post-processing thereon, such as processing for aligning the sheets P into a bundle and stapling processing for stapling the bundle of the aligned sheets.

A sheet P discharged from the image forming apparatus 100 and conveyed to the inlet port of the finisher 500 is detected by the conveyance sensor 570 and is taken into the conveying path 520 by the conveying roller pair 511. The sheet P taken into the conveying path 520 is further conveyed by the conveying roller pair 511, and the position of a side edge of the sheet P is detected by the lateral displacement detection sensor 577 disposed upstream of the shift unit 580. Thus, a displacement (lateral displacement amount) of a position of the sheet P in the width direction with respect to the center position of the width of the conveying path 520 (conveyance center position) is detected. The sheet P having its lateral displacement amount detected has its lateral displacement corrected by the first and second conveying roller pairs 512 of the shift unit 580 while being conveyed in the conveying direction. The shift unit 580 is moved by a shift motor M17, referred to hereinafter, in the width direction orthogonal to the conveying direction by a distance corresponding to the lateral displacement amount, whereby the lateral displacement is corrected. Note that the lateral displacement detection sensor 577 is implemented by an optical sensor comprised of a light emitting element and a light receiving element, and hence the lateral displacement detection sensor 577 is incapable of detecting the lateral position of a type of sheet, such as an OHP sheet or a vellum sheet, which passes light therethrough. This makes it impossible for the shift unit 580 to correct a lateral displacement of this type of sheet.

When there is a shift designation for offsetting a discharge position of every predetermined number of sheets to be discharged onto a discharge tray (hereinafter each referred to as a "discharge sheet"), a lateral displacement amount of a currently conveyed sheet with respect to the conveyance center position is detected by the lateral displacement detection sensor 577 before providing an offset shift thereto. The shift unit 580 is configured to offset, based on the detected lateral displacement amount, a sheet for near-side shift toward the near side by a predetermined amount and a sheet for far-side shift by a predetermined amount toward the far side. The amount of offset provided at this time is a value calculated by taking into account the lateral displacement amount detected by the lateral displacement detection sensor 577. When there is no shift designation for offset, sheets are caused to pass without being offset.

The discharge sheet P which has its lateral displacement corrected and is offset by the predetermined amount as required is conveyed in the conveying direction by the conveying roller pairs 512, 513, and 514, and is then conveyed e.g. into the upper discharge path 521 by switching of the flapper 551, followed by being discharged and stacked on the upper discharge tray 701. Note that after the passage of the sheet P through the shift unit 580 is detected by the conveyance sensor 571 provided in the shift unit 580, the shift motor is driven to return the shift unit 580 to the center position of the conveying path 520.

On the other hand, when binding processing or stapling processing is to be performed on sheets P, the sheets P are each conveyed from the conveying path 520 into the lower discharge path 522 by switching of the flapper 551. Then, the sheets P are each conveyed to the processing tray 630 by the conveying roller pairs 516 and 517 and so forth, and the alignment member 641 provided in the processing tray 630 aligns the sheets P into a sheet bundle. The formed sheet bundle is conveyed into the stapler 601, as required, and is subjected to stapling processing. The sheet bundle subjected to the stapling processing is discharged onto the lower discharge tray 702 by the bundle discharge roller pair 680.

In association with the upper discharge tray 701, there are provided thereabove alignment plates 711 as an alignment member, a sheet surface detection sensor 541, and an alignment plate lift HP sensor 714 for detecting the home position of each of the alignment plates 711. Further, in association with the lower discharge tray 702, there are provided thereabove alignment plates 712, a sheet surface detection sensor 542, and an alignment plate lift HP sensor 715. Each of the sheet surface detection sensors 541 and 542 detects the uppermost surface position of sheets on the associated tray. A tray lift motor M15 or M16, referred to hereinafter, is driven according to an input from the associated sheet surface detection sensor 541 or 542, whereby control is performed such that the uppermost surface of sheets on the associated tray is always held at a fixed position.

Figure 3A:
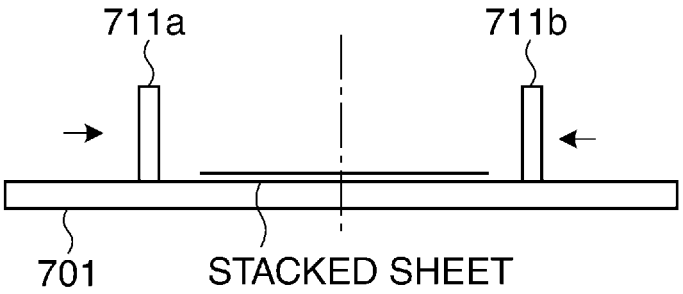
FIG. 3A is a view of an upper discharge tray, as viewed in a sheet discharging direction.
Figure 3B:
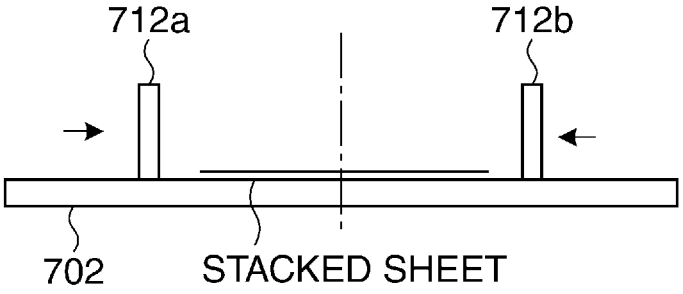
FIG. 3B is a view of a lower discharge tray, as viewed in the sheet discharging direction.

FIGS. 3A and 3B are views of a discharge tray, as viewed in a sheet discharging direction, in which FIG. 3A shows the upper discharge tray 701, and FIG. 3B shows the lower discharge tray 702. The upper discharge tray 701 and the lower discharge tray 702 are respectively provided with the alignment plates, denoted here by 711*a* and 711*b*, respectively, and the alignment plates, denoted here by 712*a* and 712*b*, respectively, for aligning the position of each of discharged sheets P in the width direction. The alignment plates 711*a* and 711*b* are driven in the width direction by respective upper tray alignment motors M9 and M10, referred to hereinafter. The alignment plates 712*a* and 712*b* are driven similarly by respective lower tray alignment motors M11 and M12, referred to hereinafter. Further, the alignment plates 711 and 712 are pivotally moved up and down about the rotational axes of respective associated alignment plate shafts 713 between an alignment position (the same position as the standby position in the vertical direction) and a lifted position (see FIGS. 4A and 4B) by respective actions of an upper tray alignment plate lift motor M13 and a lower tray alignment plate lift motor M14, each referred to hereinafter.

Figure 4A:
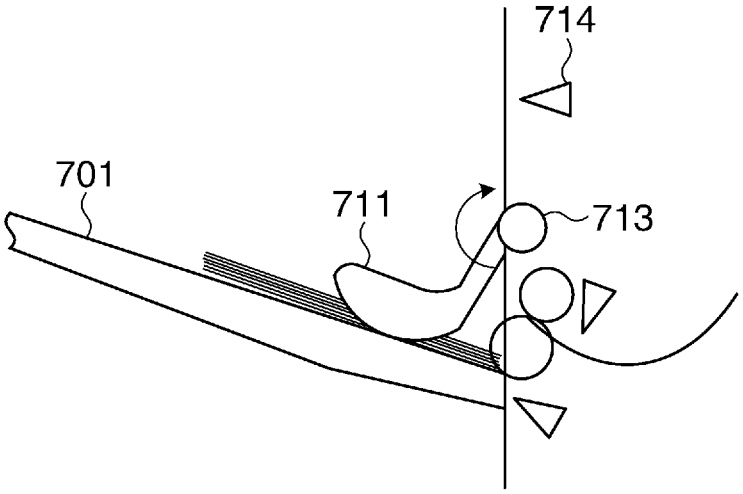
FIG. 4A is a view showing a positional relationship between a sheet placement surface of a discharge tray and alignment plates in an alignment position.
Figure 4B:
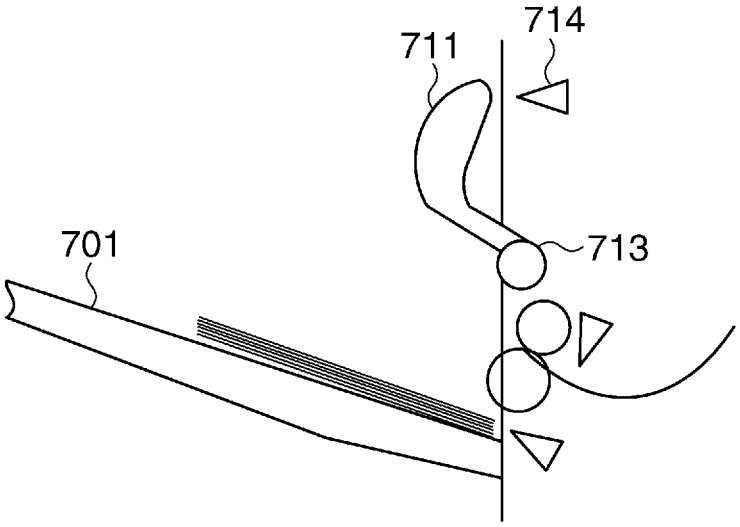
FIG. 4B is a view showing a positional relationship between the sheet placement surface of the discharge tray and the alignment plates in a lifted position.

FIGS. 4A and 4B are views each showing a positional relationship between a sheet placement surface of the discharge tray and an alignment plate. FIG. 4A shows a state where the alignment plate is in the alignment position (standby position), and FIG. 4B shows a state where the alignment plate is in the lifted position. Referring to FIGS. 4A and 4B, e.g. the alignment plate 711 in the lifted position (see FIG. 4B) as a retracted position is pivotally moved downward about the rotational axis of the alignment plate shaft 713 to the alignment position (see FIG. 4A) by driving of the upper tray alignment plate lift motor M13 so as to align discharged sheets P. The upper discharge tray 701 can be lifted up and down by the tray lift motor M15.

Note that both in the alignment position and the standby position, the alignment plates 711 are positioned on the sheet placement surface of the upper discharge tray 701. Referring to FIG. 4A, the alignment position and the standby position are the same in vertical position (height). The alignment position is a position where the pair of alignment plates are brought into abutment with the side edges of sheets to align the sheets, while the standby position is a position where the pair of alignment plates are held on standby for alignment processing by being positioned distant from the respective side edges of sheets by a predetermined standby distance D. The pair of alignment plates are adjusted when in the lifted position such that the distance between the two alignment plates becomes the same distance as the distance set for the standby state, and are then lifted down to the standby position. The alignment plates having moved to the standby position each move along the sheet placement surface by a predetermined distance (slightly larger than a standby distance D, described hereinafter with reference to FIGS. 11A and 11B) to the alignment position to thereby align the sheets P in the alignment position. The configuration of the lower discharge tray 702 and the alignment plates 712 provided on the lower discharge tray 702 is the same as that of the upper discharge tray 701 and the alignment plates 711, and hence description thereof is omitted.

Next, a description will be given of the control configuration of the whole image forming system 1000 including a controller that controls the overall operation of the image forming system 1000 shown in FIG. 1.

Figure 5:
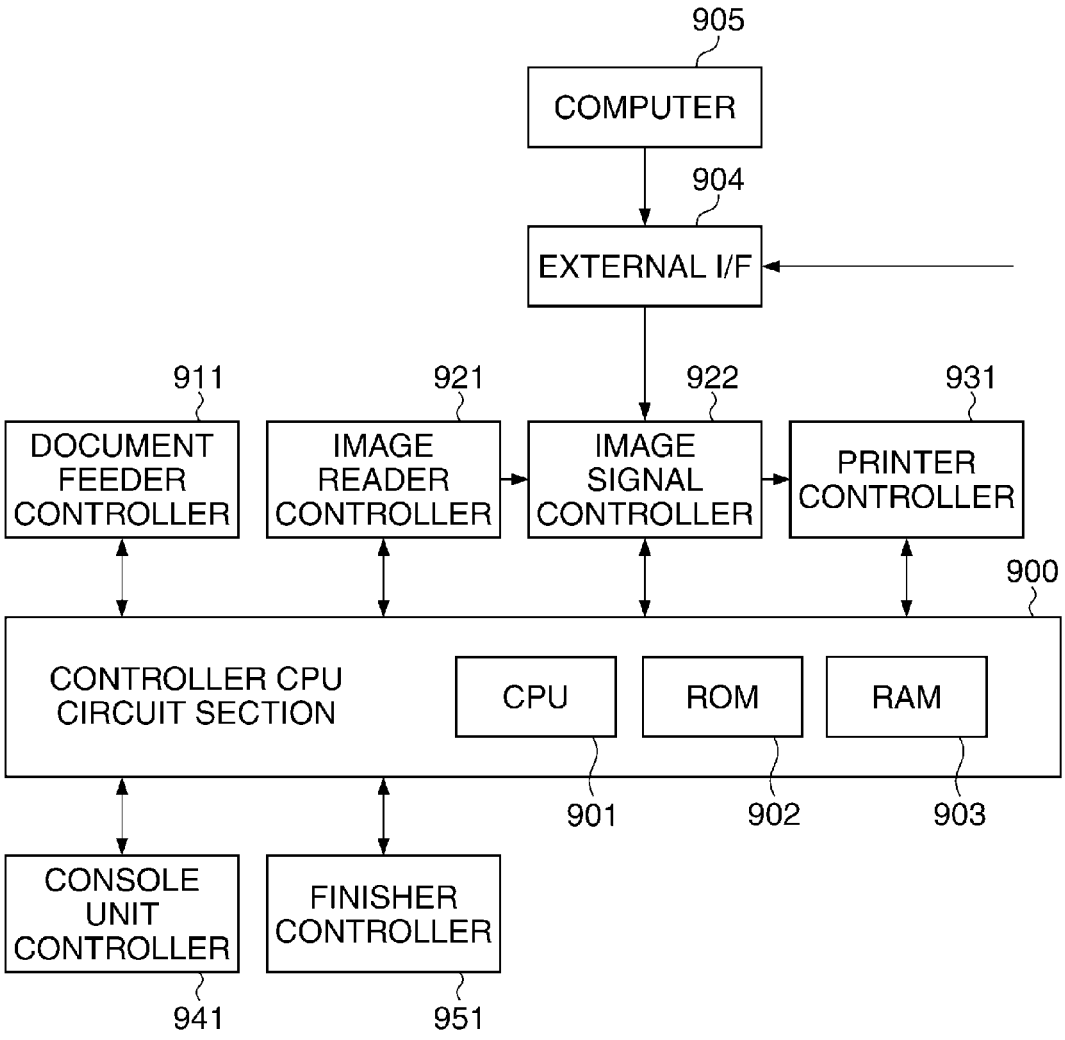
FIG. 5 is a block diagram showing the control configuration of the image forming system in FIG. 1.

FIG. 5 is a block diagram showing the control configuration of the image forming system 1000 shown in FIG. 1.

Referring to FIG. 5, the image forming system 1000 has a controller CPU circuit section 900 as a controller, and the controller CPU circuit section 900 includes a CPU 901, a ROM 902, and a RAM 903. The CPU 901 performs basic control of the whole image forming system 1000, and is connected by a data bus, not shown, to the ROM 902 having control programs written therein and the RAM 903 for use in performing processing. The CPU 901 is connected to a document feeder controller 911, an image reader controller 921, an image signal controller 922 connected to an external interface 904, a printer controller 931, a console unit controller 941, and a finisher controller 951, and performs centralized control of these according to the control programs stored in the ROM 902. The RAM 903, which temporally holds control data, is used as a work area for arithmetic operations involved in control processing.

The document feeder controller 911 controls the driving of the document feeder 300 based on instructions from the controller CPU circuit section 900. The image reader controller 921 controls the driving of the aforementioned image sensor 109 and transfers an analog image signal output from the image sensor 109 to the image signal controller 922.

The image signal controller 922 performs various processing after converting an analog image signal from the image sensor 109 to a digital signal, and converts the digital signal to an image signal to output the image signal to the printer controller 931. Further, the image signal controller 922 performs various processing on a digital image signal input from a computer 905 via the external interface 904, converts the digital image signal to an image (video) signal, and outputs the video signal to the printer controller 931. Processing operations by the image signal controller 922 are controlled by the controller CPU circuit section 900. The printer controller 931 controls the printer 350 based on the input video signal to thereby perform image formation and sheet conveyance.

The finisher controller 951 is installed in the finisher 500, and controls the driving of the whole finisher 500 by exchanging information with the controller CPU circuit section 900. Details of the control will be described hereinafter.

The console unit controller 941 exchanges information with the console unit 600 and the controller CPU circuit section 900. The console unit 600 has a plurality of keys for configuring various functions concerning image formation, a display section that displays information indicating a configuration state, and so forth. The console unit 600 outputs a key signal corresponding to an operation of each key to the controller CPU circuit section 900. Further, based on a signal from the controller CPU circuit section 900, the console unit 600 displays corresponding information on the display section.

Next, a description will be given of the configuration of the finisher controller 951 that controls the driving of the finisher 500.

Figure 6:
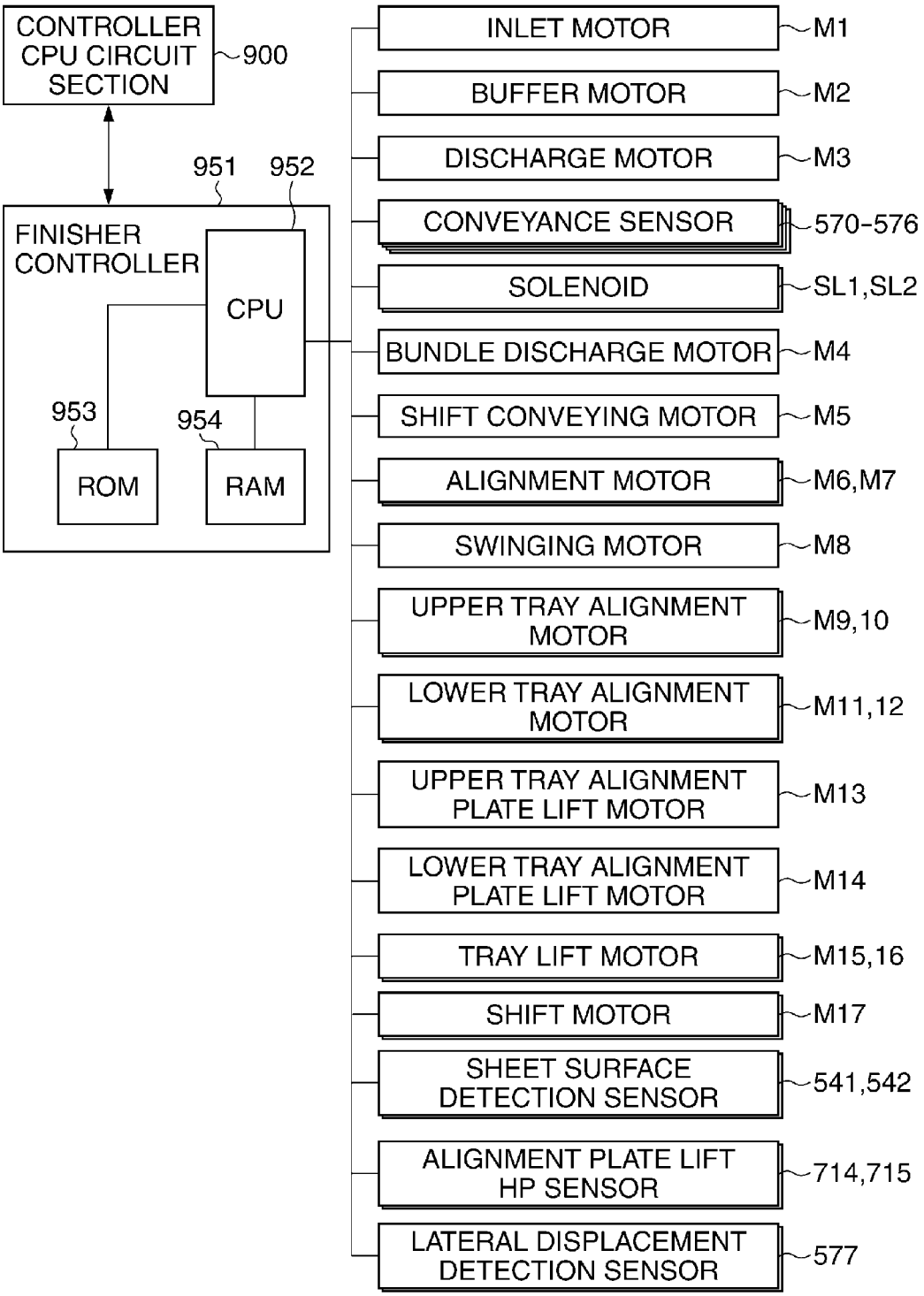
FIG. 6 is a block diagram of a finisher controller appearing in FIG. 5.

FIG. 6 is the block diagram of the finisher controller 951 shown in FIG. 5.

As shown in FIG. 6, the finisher controller 951 is comprised of a CPU 952, a ROM 953, and a RAM 954. The finisher controller 951 is connected to the controller CPU circuit section 900 provided in the image forming system 1000 via a communication IC, not shown, and communicates with the controller CPU circuit section 900 to exchange data including job information and notifications of passing of each sheet. More specifically, the finisher controller 951 executes various programs stored in the ROM 953 according to instructions from the controller CPU circuit section 900, to thereby control various motors and sensors described below.

The finisher controller 951 is controllably connected to various motors and sensors, and solenoids SL1 and SL2. The motors include an inlet motor M1, a buffer motor M2, a discharge motor M3, a bundle discharge motor M4, a shift conveying motor M5, alignment motors M6 and M7, a swinging motor M8, the upper tray alignment motors M9 and M10, and the lower tray alignment motors M11 and M12. Further, the motors include the upper tray alignment plate lift motor M13, the lower tray alignment plate lift motor M14, the tray lift motors M15 and M16, and the shift motor M17. The sensors include the conveyance sensors 570 to 576, the sheet surface detection sensors 541 and 542, the alignment plate lift HP sensors 714 and 715, and the lateral displacement detection sensor 577.

The inlet motor M1 drives the conveying roller pairs 511 to 513. The shift conveying motor M5 and the lateral displacement detection sensor 577 are used to correct the amount of displacement of the position in the width direction of a sheet being conveyed with respect to the conveyance center position. The bundle discharge motor M4 drives the bundle discharge roller pair 680. The alignment motors M6 and M7 drive the alignment member 641. The swinging motor M8 lifts up and down a swinging guide, not shown. The tray lift motors M15 and M16 and the sheet surface detection sensors 541 and 542 are provided as input and output means for lifting up and down the upper discharge tray 701 and the lower discharge tray 702. The upper tray alignment motors M9 and M10, the lower tray alignment motors M11 and M12, the upper tray alignment plate lift motor M13, the lower tray alignment plate lift motor M14, and the alignment plate lift HP sensors 714 and 715 are provided as input and output means for alignment operation on the discharge trays.

Next, a description will be given of a process for calculating an offset amount and a distance between an alignment plate and a sheet edge (hereinafter referred to as "the offset amount-calculating process"), which is performed in a case where after an image is formed on a sheet P using the image forming system in FIG. 1, the sheet P is guided into the finisher 500 and is discharged onto one of the discharge trays.

Using the console unit 600, the user registers and sets basic conditions for the image forming apparatus 100 and conditions for an image forming job, as preconditions for performing the offset amount-calculating process.

Figure 7:
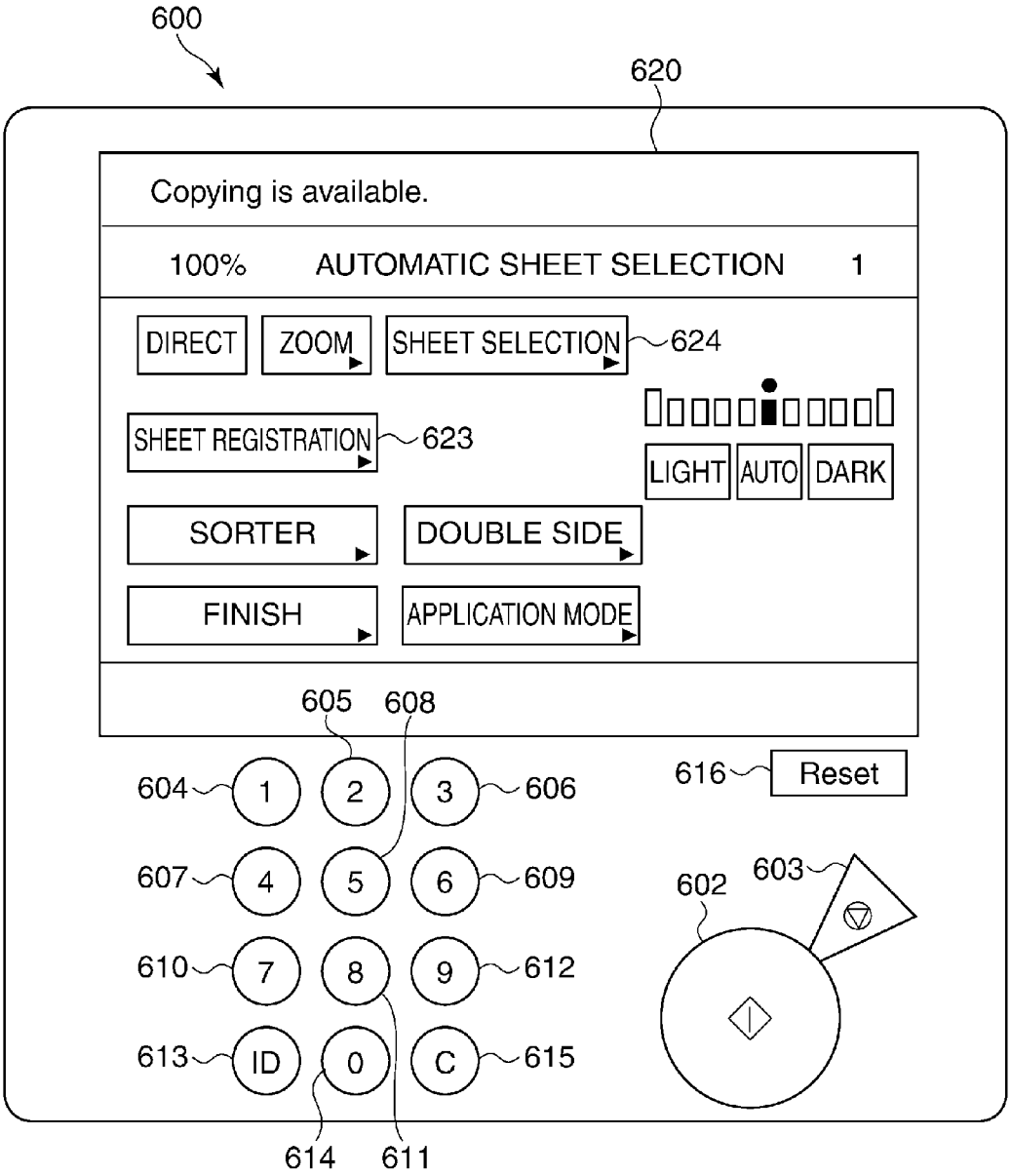
FIG. 7 is a view of a console unit of the image forming system in FIG. 1.

FIG. 7 is a view of the console unit 600 provided in the image forming system shown in FIG. 1.

As shown in FIG. 7, the console unit 600 is provided with a start key 602 for starting an image forming operation, a stop key 603 for stopping the image forming operation, and ten keys 604 to 612 and 614 for entering numerical data. Further, on the console unit 600, there are arranged an ID key 613, a clear key 615, a reset key 616, and a user mode key (not shown) for configuring settings for various devices. Further, in an upper part of the console unit 600, there is disposed a display section 620 implemented by a touch panel, and soft keys are displayed on a display screen of the display section 620.

As a post-processing mode, it is possible to set any of various processing modes including a non-sorting mode, a sorting mode, a shift sorting mode, and a stapling sorting mode (binding mode). The post-processing mode is set according to user's input operation on the console unit 600. For example, in the image forming apparatus 100, the user registers a sheet material (hereinafter simply referred to as "a material") and a sheet size of sheets to be used in the image forming apparatus 100.

Figure 8A:
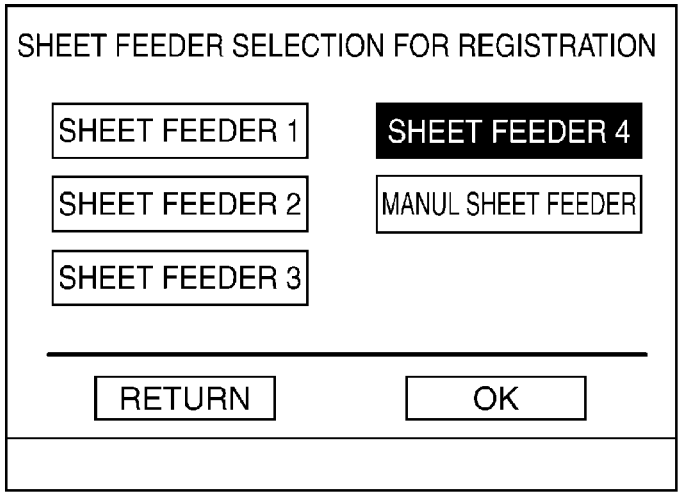
FIG. 8A is a view illustrating a sheet feeder selection screen for registration, which is displayed on the console unit.
Figure 8B:
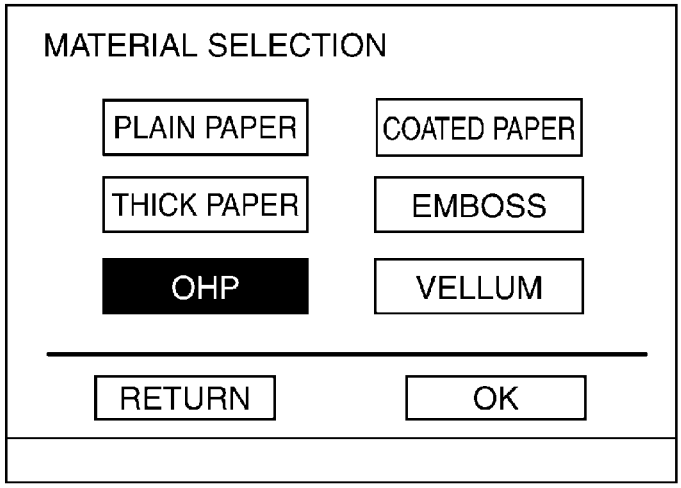
FIG. 8B is a view illustrating a material selection screen displayed on the console unit.
Figure 8C:
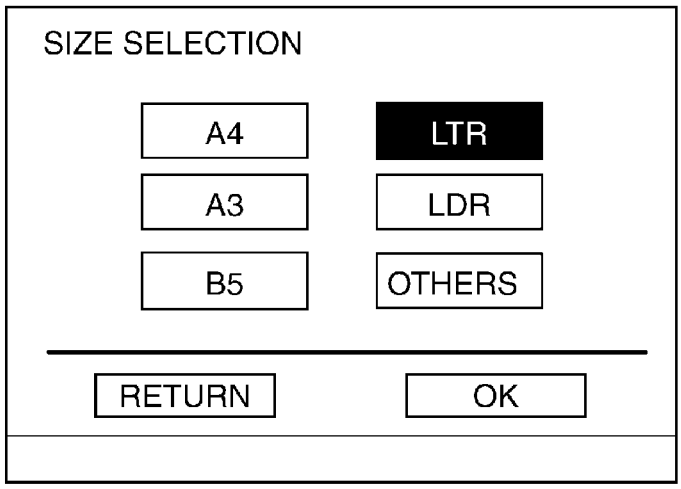
FIG. 8C is a view illustrating a size selection screen displayed on the console unit.

In the following, a description will be given, with reference to FIGS. 8A to 8C, of material registration and sheet size registration which are performed using the console unit 600. FIGS. 8A to 8C are views illustrating respective screens displayed on the console unit 600. FIG. 8A shows a sheet feeder selection screen for registration, FIG. 8B shows a material selection screen, and FIG. 8C shows a size selection screen.

In the case of registering the material and sheet size of sheets, the user presses a sheet registration key 623 on a display screen of the display section 620 appearing in FIG. 7. When the sheet registration key 623 is pressed, the display of the display section 620 shifts to the sheet feeder selection screen for registration, shown in FIG. 8A. When the user selects a sheet feeder to set the material and sheet size and presses an OK button, the display of the display section 620 shifts to the material selection screen shown in FIG. 8B. On the material selection screen shown in FIG. 8B, the user selects e.g. OHP as the material of sheets contained in the sheet feeder selected in FIG. 8A e.g. the sheet feeder 4, and presses an OK button.

When the OK button is pressed after the material is selected, the display of the display section 620 shifts to the size selection screen shown in FIG. 8C. On the size selection screen, the user selects e.g. LTR as the size of the sheets which are contained in the selected sheet feeder and are made of the selected material, and then presses an OK button. LTR represents the letter size. When the OK button is pressed after the sheet size is selected, the material and sheet size of sheets contained in the selected sheet feeder are registered, and the display of the display section 620 returns to the initial screen shown in FIG. 7.

Thereafter, the user repeats selection of a sheet feeder for registration on the FIG. 8A screen, selection of a material on the FIG. 8B screen, and selection of a sheet size on the FIG. 8C screen to thereby register in the finisher 500 the material and sheet size of sheets contained in each of the sheet feeders.

Figure 9:
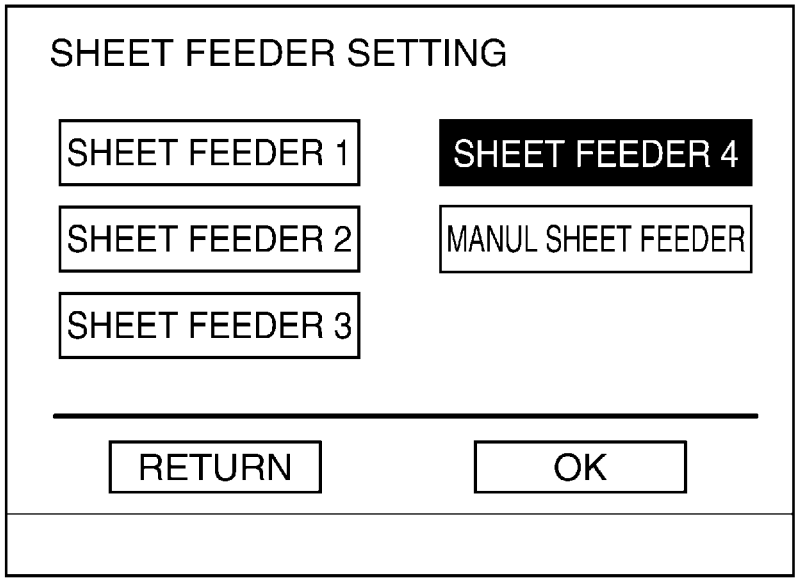
FIG. 9 is a view illustrating a sheet feeder setting screen.

After completion of the material and sheet size registration, to select and set a sheet size and a material of sheets to be used in an image forming job from the registered sheet types, the user selects and sets a sheet feeder containing the sheets. More specifically, when the user presses a sheet selection key 624 in the display section 620 on the FIG. 7 display screen, the display of the display section 620 shifts to a sheet feeder setting screen shown in FIG. 9. When the user selects a desired sheet feeder, e.g. the sheet feeder 4, and then presses an OK button on the sheet feeder setting screen shown in FIG. 9, the sheet feeder containing the sheets of the material and the sheet size for use in the image forming job is set, and then the display of the display section 620 returns to the initial screen shown in FIG. 7. Then, when the user presses the start key 602, the image forming job using the sheets contained in the set sheet feeder is performed, and sheets P each having an image formed thereon are conveyed into the finisher 500. At this time, sheet information including the material and sheet size selected by the user is sent to the CPU 952 of the finisher 500 by the CPU 901 of the image forming apparatus 100.

As soon as the finisher 500 receives the sheet information on the sheets P and starts to have the sheets P conveyed therein, the offset amount-calculating process is started.

Figure 10:
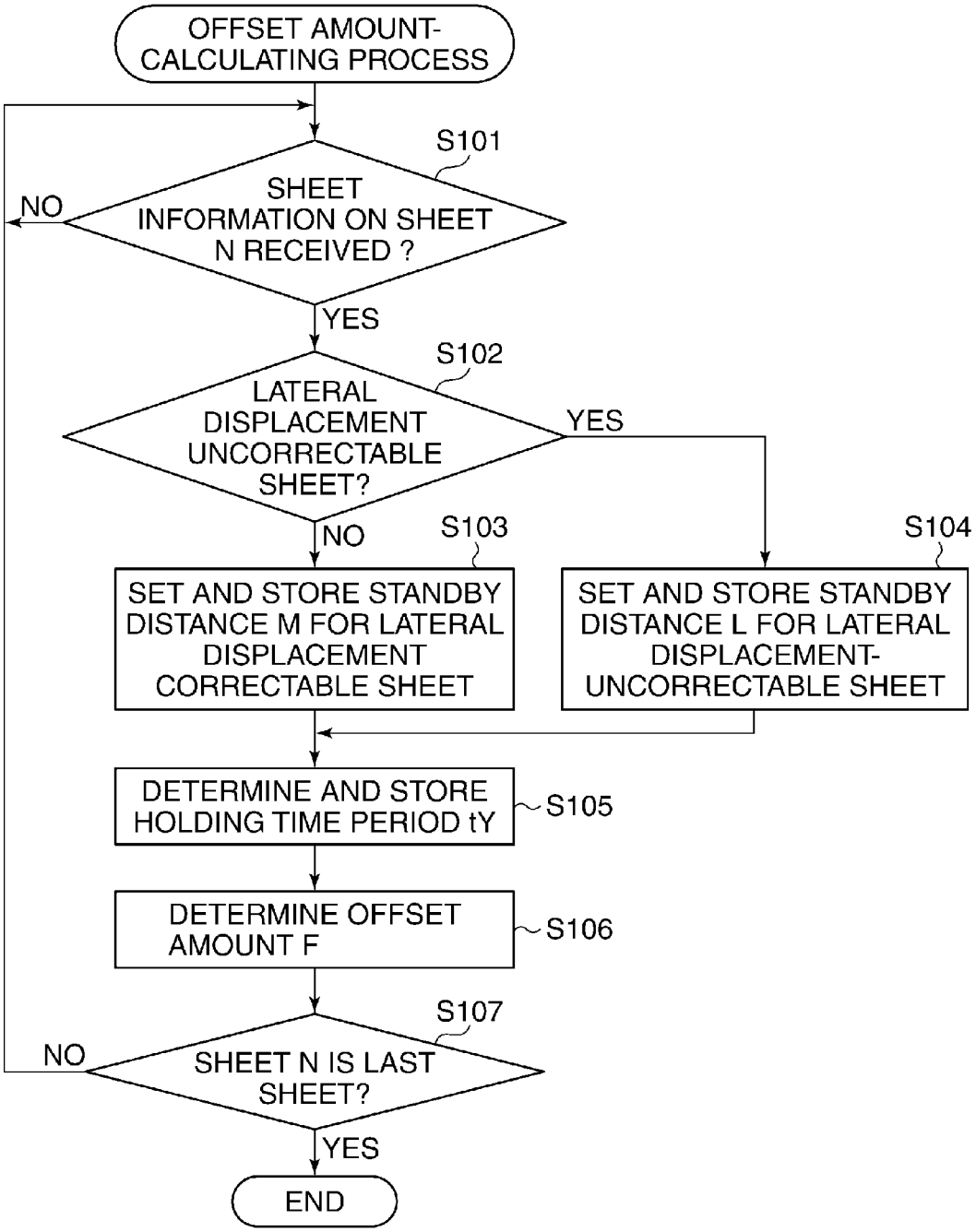
FIG. 10 is a flowchart of an offset amount-calculating process performed by the finisher shown in FIG. 2.

FIG. 10 is a flowchart of the offset amount-calculating process performed by the finisher 500 shown in FIG. 2. The offset amount-calculating process is performed by the CPU 952 of the finisher controller 951 according to a program stored in the ROM 953.

When the offset amount-calculating process is started, first, the CPU 952 determines whether or not sheet information on a sheet to be used for sheet processing has been received from the CPU 901 of the image forming apparatus 100, and if not, waits until the sheet information is received (step S101). The sheet information includes the material and sheet size of sheets P registered in the image forming apparatus 100 and selected and set for use by the user, information as to whether a last sheet flag has been set, and so forth. An N-th sheet conveyed into the finisher 500 will be hereinafter referred to as "a sheet N". When sheet information on the sheet N is received anew, the CPU 952 updates the sheet information received before.

Then, after having received the sheet information on the sheet N (YES to the step S101), the CPU 952 determines whether or not the sheet N is a lateral displacement uncorrectable sheet (step S102). A sheet whose material is OHP or vellum paper or whose sheet size is smaller than a predetermined size, e.g. A5R, is not subjected to lateral displacement correction, and hence this type of sheet is referred to as a lateral displacement uncorrectable sheet. The lateral displacement uncorrectable sheet is a translucent sheet which passes light therethrough with an optical transmittance higher than a predetermined value, which makes it impossible to identify the presence or absence of the sheet, or a sheet having such a small width that the sheet width cannot be detected due to limitation of the movement range of detection sensors. On the other hand, a sheet of any other type that is subjected to lateral displacement correction is referred to as a lateral displacement correctable sheet.

If it is determined in the step S102 that the sheet N is not a lateral displacement uncorrectable sheet, the CPU 952 sets the standby distance D to a standby distance M (e.g. 5 mm) to be set for a lateral displacement correctable sheet and stores the standby distance M in the RAM 954 (step S103).

Figure 11A:
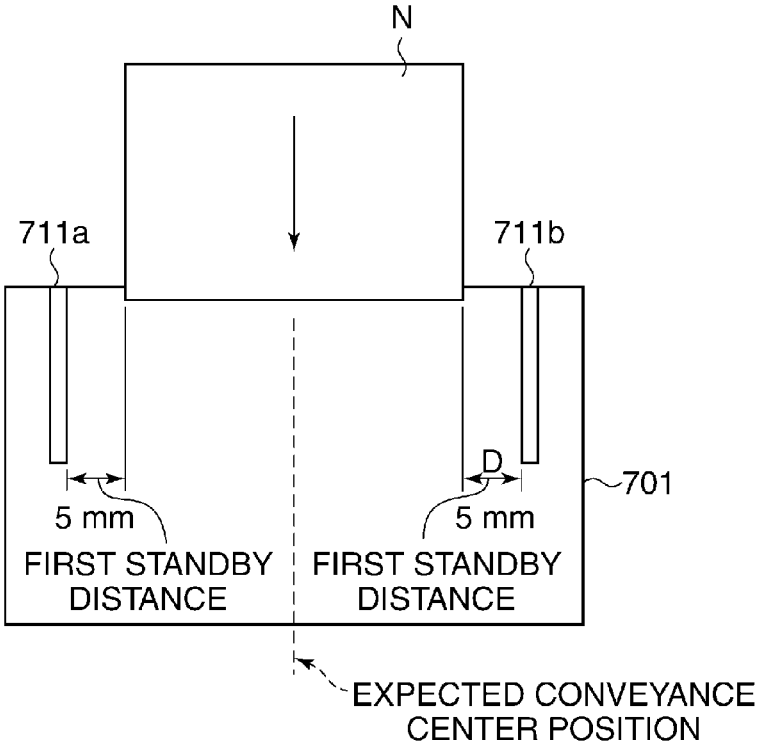
FIG. 11A is a view useful in explaining a standby distance for a lateral displacement correctable sheet.
Figure 11B:
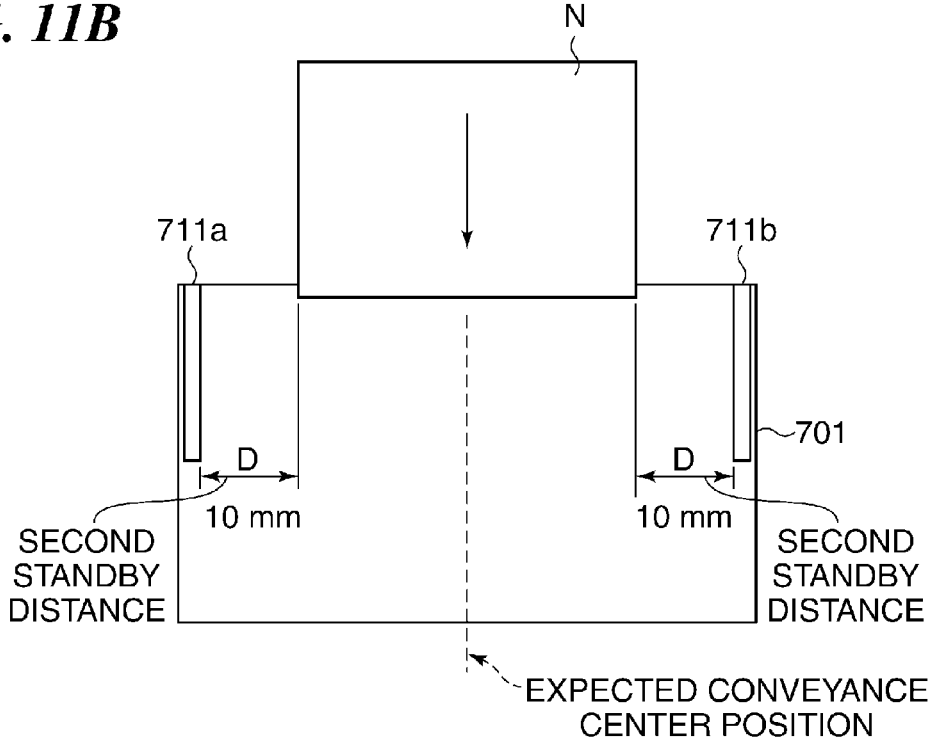
FIG. 11B is a view useful in explaining a standby distance for a lateral displacement uncorrectable sheet.

FIGS. 11A and 11B are views useful in explaining the standby distances. FIG. 11A is a view useful in explaining the standby distance for a lateral displacement correctable sheet, and FIG. 11B is a view useful in explaining a standby distance for a lateral displacement uncorrectable sheet.

Referring to FIG. 11A, when a sheet N to be discharged onto the upper discharge tray 701 is a lateral displacement correctable sheet, the standby distance D which is a distance between each of the alignment plates 711*a* and 711*b* in the standby position and an associated one of the sheet edges of the sheet N is set to the predetermined length M (e.g. 5 mm). More specifically, the alignment plates 711*a* and 711*b* are each kept on standby at a position 5 mm away from an associated sheet edge of the sheet N in an ideal position which is a position to which the sheet N is assumed to be discharged, when it is free from lateral displacement, such that the center of the sheet in the width direction extends on the center of the upper discharge tray 701 in the width direction. The standby distance D for a lateral displacement correctable sheet will be hereinafter referred to as the first standby distance. The first standby distance M is determined by taking into account a maximum value of the amount of lateral displacement which is expected to be caused in the course of conveyance of a sheet N having its lateral displacement corrected by the shift unit 580 of the finisher 500 to the upper discharge tray 701. More specifically, the first standby distance M is set based on an empirical rule that a lateral displacement correctable sheet having its lateral displacement corrected by the shift unit 580 is not laterally displaced by more than 5 mm in the course of conveyance to the upper discharge tray 701. Therefore, by setting the first standby distance M to 5 mm as in FIG. 11A, it is possible to discharge the sheet N onto the upper discharge tray 701 without bringing the same into collision with any of the alignment plates 711*a* and 711*b*.

On the other hand, when the sheet N, which is to be discharged onto the upper discharge tray 701, is a lateral displacement uncorrectable sheet as shown in FIG. 11B, the standby distance D which is a distance between each of the alignment plates 711*a* and 711*b* in the standby position and an associated one of the sheet edges of the sheet N in the ideal position is set to a predetermined length L (e.g. 10 mm). More specifically, the alignment plates 711*a* and 711*b* are each kept on standby at a position 10 mm away from an associated sheet edge of the sheet N in the ideal position to which the sheet N is assumed to be discharged such that the center of the sheet in the width direction extends on the center of the upper discharge tray 701 in the width direction. The standby distance D for a lateral displacement uncorrectable sheet will be hereinafter referred to as the second standby distance. The second standby distance L is determined by taking into account a maximum value of the amount of lateral displacement which is expected to be caused in the course of conveyance of a sheet N which has been conveyed in from the image forming apparatus 100 located upstream to the upper discharge tray 701 without having its lateral displacement corrected by the shift unit 580 of the finisher 500. More specifically, the second standby distance L is set based on an empirical rule that even a sheet N whose lateral displacement is not corrected by the shift unit 580 is not laterally displaced by more than 10 mm in the course of conveyance to the upper discharge tray 701 after being conveyed in from the image forming apparatus 100. Therefore, by setting the second standby distance L e.g. to 10 mm as in FIG. 11B, it is possible to discharge the sheet N onto the upper discharge tray 701 without bringing the same into collision with any of the alignment plates 711*a* and 711*b* even if the sheet N is a lateral displacement uncorrectable sheet.

Referring again to FIG. 10, after setting and storing the first standby distance M as the standby distance D in the step S103, the CPU 952 determines a holding time period tY and stores the same in the RAM 954 (step S105).

Figure 12A:
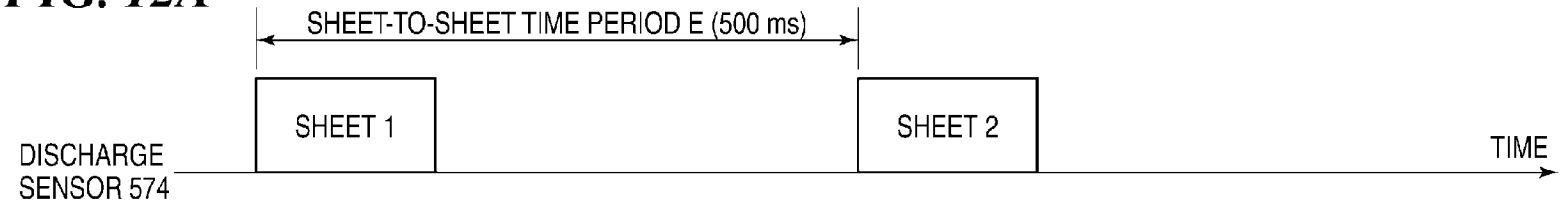
FIG. 12A is a diagram useful in explaining a holding time period, which shows a sheet-to-sheet time interval.
Figure 12B:
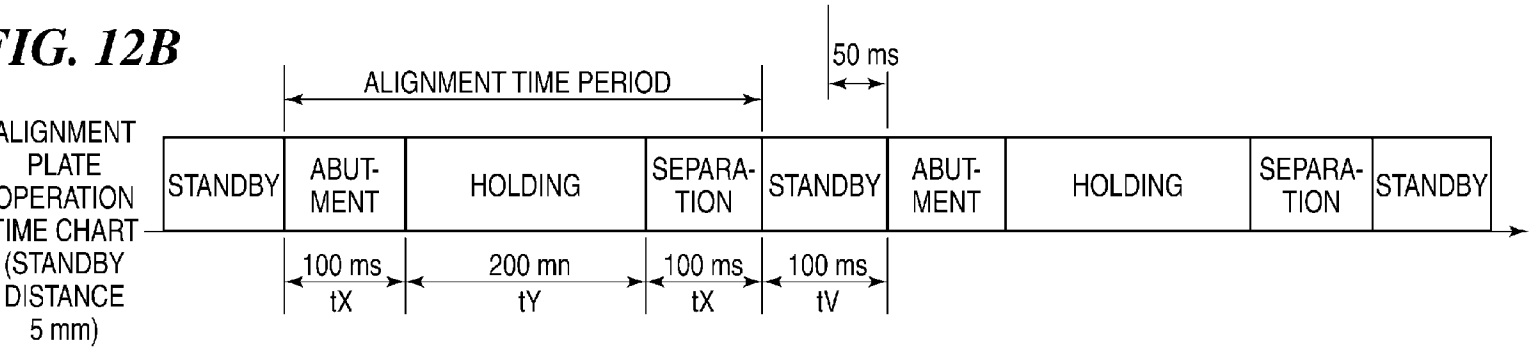
FIG. 12B is a diagram useful in explaining the holding time period, which shows a time period over which a lateral displacement correctable sheet is held.
Figure 12C:
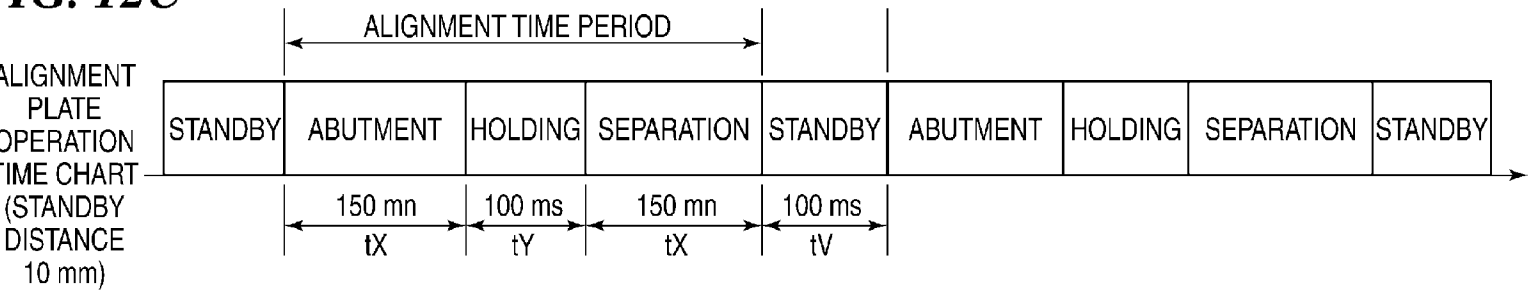
FIG. 12C is a diagram useful in explaining the holding time period, which shows a time period over which a lateral displacement uncorrectable sheet is held.

FIGS. 12A to 12C are diagrams useful in explaining the holding time period tY. FIG. 12A shows a sheet-to-sheet time interval. FIG. 12B shows a holding time period over which a lateral displacement correctable sheet is held, and FIG. 12C shows a holding time period over which a lateral displacement uncorrectable sheet is held.

As shown in FIGS. 12B and 12C, a time period required for alignment of a sheet N to be discharged onto the discharge tray (hereinafter referred to as "the alignment time period") is a total of a movement-for-abutment time period, a movement-for-separation time period, and the holding time period. The movement-for-abutment time period is a time period required for movement of one of the alignment plates from the standby position to the alignment position. The movement-for-separation time period is a time period required for movement of the one of the alignment plates from the alignment position to the standby position. Further, the holding time period is a time period over which the pair of alignment plates are held in contact with the sheet N, after the abutment with the sheet edges till separation from the same.

The alignment plates that align a sheet on the discharge tray need a standby time period before starting alignment of a sheet following a sheet N after having aligned the sheet N by performing the abutment operation, the holding operation, and the separation operation. More specifically, a total of the alignment time period for performing an abutment operation, a holding operation, and a separation operation, and the standby time period (a minimum value of the standby time period is assumed to be e.g. 100 ms) is required to be shorter than the sheet-to-sheet time interval E shown in FIG. 12A. The sheet-to-sheet time interval E is a time period from when the leading edge of an earlier one of two successive sheets which are to be sequentially discharged passes the discharge sensor 574 to when the leading edge of the following one of them passes the discharge sensor 574. Thus, the total of the alignment time period for sheet alignment and the standby time period is limited by the sheet-to-sheet time interval E. Timing for starting the abutment of the alignment plates 711 with the following sheet N corresponds to timing in which a predetermined time period, e.g. 50 ms elapses after the leading edge of the following sheet N passes the discharge sensor 574, as shown in FIG. 12B.

Now, when each of the movement-for-abutment time period and the movement-for-separation time period is represented by tX, and the standby time period is represented by tV, the holding time period tY, which is calculated with a prerequisite that a longest possible holding time period is secured, is expressed by the following equation (1):

$$\text{holding time period } tY = \text{sheet-to-sheet time interval } E - (\text{movement-for-abutment time period } tX + \text{movement-for-separation time period } tX) - \text{standby time period } tV \quad (1)$$

In a case where the first standby distance M is set to 5 mm for the lateral displacement correctable sheet in FIG. 12B, assuming that the sheet-to-sheet time interval E is 500 ms, each of the movement-for-abutment time period tX and the movement-for-separation time period tX is set 100 ms, and the standby time period is 100 ms, the holding time period tY is calculated by the equation (1) as 500−(100+100)−100=200 (ms).

Further, in a case where the second standby distance L is set to 10 mm for the lateral displacement uncorrectable sheet in FIG. 12C, assuming that the sheet-to-sheet time interval E is 500 ms, each of the movement-for-abutment time period tX and the movement-for-separation time period tX of the alignment plates is 150 ms, and the standby time period is 100 ms, the holding time period tY is calculated by the equation (1) as 500−(150+150)−100=100 (ms). Note that since the second standby distance L is longer than the first standby distance M, the moving speed of the alignment plate for alignment of a lateral displacement uncorrectable sheet is set to be slightly (1.34 times) faster than for alignment of a lateral displacement correctable sheet. Note that to reduce damage to the sheet, the moving speed of the alignment plate may be reduced immediately before the alignment plate is brought into abutment with the sheet.

As the standby distance D in FIG. 11A or 11B is set to be longer, possibility of collision of a discharge sheet N against the alignment plates 711 is reduced. However, the holding time period for a lateral displacement uncorrectable sheet is set to be shorter than the holding time period for a lateral displacement correctable sheet as described above, and hence, in general, alignment performance of the lateral displacement uncorrectable sheet is degraded compared with alignment performance of the lateral displacement correctable sheet.

However, if the standby distance D is set to be shorter, e.g. to 5 mm to secure a holding time period for improvement of alignment performance, possibility of collision of the discharge sheet N against the alignment plates 711 increases, and hence there is a fear that alignment performance becomes much worse than when the standby distance D is set to 10 mm.

To overcome this problem, in the present embodiment, the standby distance D (first standby distance M) for a lateral displacement correctable sheet is set e.g. to 5 mm, and the standby distance D (second standby distance L) for a lateral displacement uncorrectable sheet is set e.g. to 10 mm which is longer than 5 mm. With this, even lateral displacement uncorrectable sheets are discharged with improved alignment performance while avoiding collision against the alignment plates 711, so as to form an excellent sheet bundle.

Referring again to FIG. 10, after determining the holding time period tY and storing the same in the RAM 954 (step S105), the CPU 952 determines an offset amount F for the shift unit 580 (step S106).

Figure 13A:
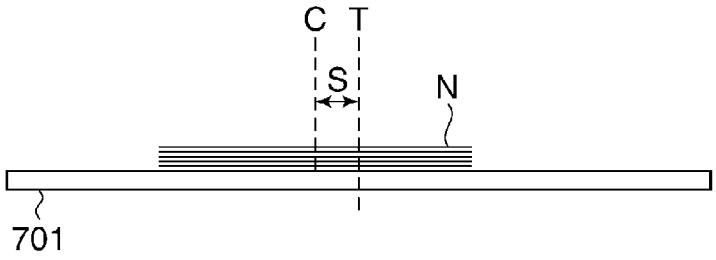
FIG. 13A is a view useful in explaining an offset amount, which shows a shift amount as part of the offset amount.
Figure 13B:
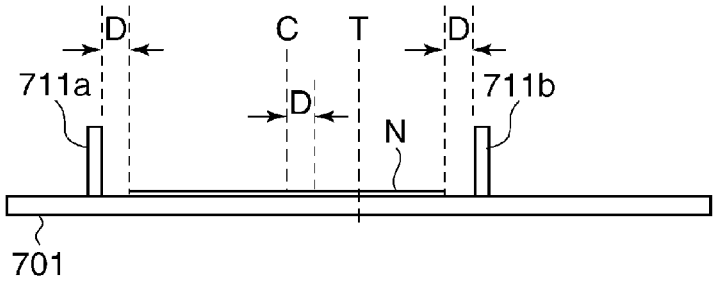
FIG. 13B is a view useful in explaining the offset amount, which shows the alignment plates in a standby position with respect to a discharge sheet.
Figure 13C:
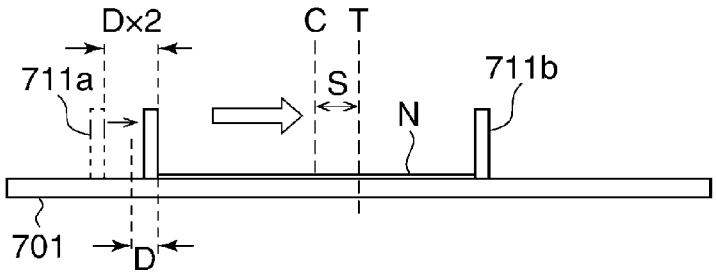
FIG. 13C is a view useful in explaining the offset amount, which shows an alignment operation by the alignment plates.
Figure 13D:
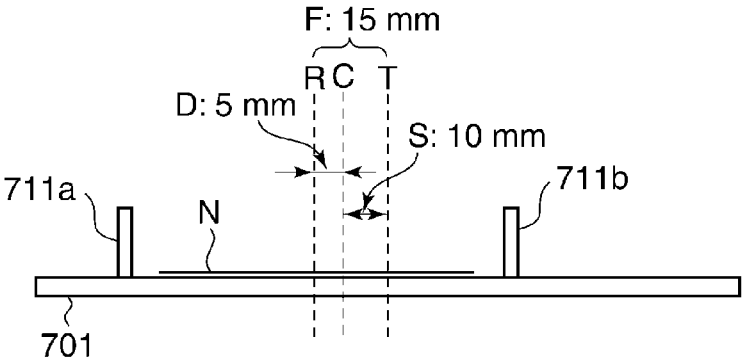
FIG. 13D is a view useful in explaining the offset amount, which shows the offset amount.

FIGS. 13A to 13D are views useful in explaining the offset amount. FIG. 13A shows a shift amount S as part of the offset amount. FIG. 13B shows the alignment plates in the standby position for alignment of a discharge sheet. FIG. 13C shows an alignment operation by the alignment plates, and FIG. 13D shows the offset amount.

In FIG. 13A, a center C of a sheet bundle formed by sheets N discharged onto the upper discharge tray 701 and aligned thereon is shifted by a distance S from a center T of the sheet placement surface of the upper discharge tray 701 in a leftward direction as viewed in FIG. 13A. The distance S is referred to as the shift amount. Note that when the shift amount is equal to 0, the center C of a sheet bundle matches the center T of the upper discharge tray 701.

To form a sheet bundle shifted leftward by the distance S as shown in FIG. 13A, each sheet N is discharged as shown in FIG. 13B. More specifically, each sheet N is discharged such that its center C is positioned distant from the center T of the upper discharge tray 701 in the leftward direction, as viewed in FIG. 13B, by the sum (i.e. the offset amount F, referred to hereinafter) of the shift amount S+the standby distance D. Actually, however, the positions of discharged sheets vary. At this time, the alignment plates 711*a* and 711*b* are adjusted such that each of them is positioned distant from the associated side edge (side edge under a condition without variation) of a discharged sheet N by the standby distance D. Therefore, a distance between the alignment plates 711*a* and 711*b* is equal to a distance obtained by adding standby distance D×2 to the width of the sheet N. The sheet N is discharged in between the alignment plates 711*a* and 711*b* positioned as described above.

As the alignment plate 711*a* is moved rightward, as viewed in FIG. 13B, by the amount of standby distance D×2 in the state shown in FIG. 13B, one side edge of the sheet N is pushed by the alignment plate 711*a*, until the other side edge of the same is brought into abutment with the alignment plate 711*b* and stopped. At this time, the alignment plate 711*b* does not change its position, so that the sheet N is moved by the distance D in the direction indicated by a hollow arrow in FIG. 13C and is aligned to a position where its center C is shifted from the center T of the upper discharge tray 701 by the shift amount S, as shown in FIG. 13C. The discharge sheet alignment process is performed on every discharge sheet N, and consequently a sheet bundle is formed at the position shifted from the center T of the upper discharge tray 701 by the distance S.

A predetermined distance by which the shift unit 580 shifts a sheet N in the width direction orthogonal to the conveying direction so as to discharge the sheet N in a desired shift position is referred to as the offset amount F. As shown in FIG. 13D, the offset amount F is expressed as the sum of the shift amount S and the standby distance D (see the following equation (2)).

$$\text{offset amount } F = \text{shift amount } S + \text{standby distance } D \times 1 \quad (2)$$

As described above, when it is desired to form a sheet bundle at the position shifted leftward, as viewed in FIGS. 13A to 13D, from the center T of the upper discharge tray 701 by the distance S, the offset amount for the shift unit 580 is set to S+D. The position of the center of the sheet after offset is a position R indicated in FIG. 13D.

When a sheet N is a lateral displacement correctable sheet, the standby distance D is set e.g. to 5 mm (first standby distance). On the other hand, when the sheet N is a lateral displacement uncorrectable sheet, the standby distance D is set e.g. to 10 mm (second standby distance). Therefore, assuming that the shift amount S is e.g. 10 mm, the offset amount for alignment of a lateral displacement correctable sheet is e.g. 10+5=15 (mm), and the offset amount for alignment of a lateral displacement uncorrectable sheet is e.g. 10+10=20 (mm).

Referring again to FIG. 10, after determining the offset amount, the CPU 952 determines whether or not the sheet N is the last sheet (step S107). If it is determined in the step S107 that the sheet N is the last sheet (YES to the step S107), the CPU 952 terminates the present process. On the other hand, if it is determined in the step S107 that the sheet N is not the last sheet (NO to the step S107), the present process returns to the step S101.

If it is determined in the step S102 that the sheet N is a lateral displacement uncorrectable sheet (YES to the step S102), the CPU 952 proceeds to a step S104. More specifically, the CPU 952 sets the standby distance D to the standby distance L (e.g. 10 mm) for alignment of a lateral displacement uncorrectable sheet and stores the standby distance L in the RAM 954 (step S104), and then the CPU 952 proceeds to the step S105.

According to the FIG. 10 process, the standby distance D is changed depending on whether a sheet N to be processed is a lateral displacement correctable sheet or a lateral displacement uncorrectable sheet, and then the offset amount for the shift unit 580 is determined using the changed standby distance D. Therefore, it is possible to accurately calculate an offset amount corresponding to the standby distance D for alignment of a sheet N to be processed.

Next, a description will be given of a discharge sheet alignment process performed using the offset amount determined in FIG. 10.

Figure 14:
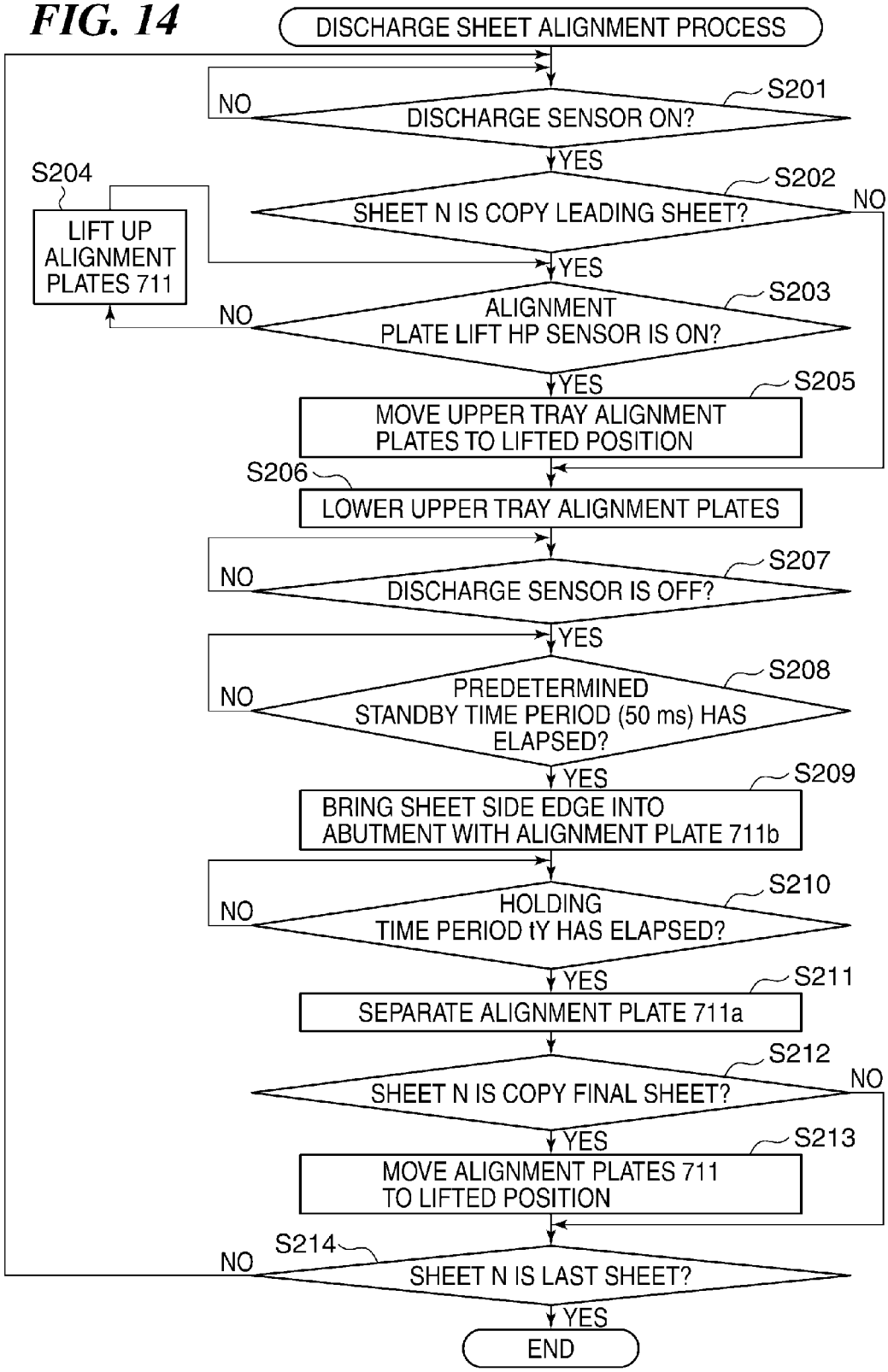
FIG. 14 is a flowchart of a discharge sheet alignment process.

FIG. 14 is a flowchart of the discharge sheet alignment process. This discharge sheet alignment process is performed by the CPU 952 of the finisher 500 based on a program stored in the ROM 953. First, a conveyance process in which a sheet N is conveyed to the discharge tray of the finisher 500 will be described prior to the description of the discharge sheet alignment process.

When sheets N are to be conveyed into the finisher 500 from the image forming apparatus 100, the CPU 901 of the image forming apparatus 100 notifies the CPU 952 of the finisher 500 of the start of sheet delivery. Then, when the CPU 952 receives sheet information on a leading sheet of the job from the CPU 901 of the image forming apparatus 100, the discharge sheet alignment process is started. The sheet information includes not only information on whether the sheet is a lateral displacement correctable sheet or a lateral displacement uncorrectable sheet, a last sheet flag of the sheets N, a copy leading sheet flag, a copy final sheet flag, and a discharge tray, but also information on a shift amount to be applied to the discharge of the sheets N. Hereafter, a description will be given by taking an example of a case where the sheet N is a lateral displacement correctable sheet, the last sheet flag is off, the copy leading sheet flag is on, the copy final sheet flag is off, the shifting direction is toward the far side, and the upper discharge tray is designated as the discharge tray.

Upon receipt of the notification of the start of sheet delivery from the CPU 901, first, the CPU 952 drives the inlet motor M1, the buffer motor M2, the discharge motor M3, and the shift conveying motor M5. As a consequence, the conveying roller pairs 511, 512, 513, 514, and 515 are driven for rotation, whereby the sheet N discharged from the image forming apparatus 100 is taken into the finisher 500.

Then, when the conveyance sensor 571 provided in the shift unit 580 detects that the conveying roller pairs 512 have nipped the sheet N, the CPU 952 drives the shift motor M17 to offset the shift unit 580 toward the far side by the predetermined offset amount. In a case where the sheet N conveyed into the shift unit 580 is laterally displaced at this time, the shift unit 580 shifts the sheet N such that it is brought to a position which is offset by the predetermined offset amount from an ideal position of the sheet N which is a position where the sheet N assumed to be free from lateral displacement is to be in. The offset amount is set to an offset amount of e.g. 15 mm, which was determined in the step S106 in FIG. 10. Note that when the sheet N is a lateral displacement uncorrectable sheet, the offset amount is set e.g. to 20 mm.

Then, the CPU 952 switches the flapper 551 by driving the solenoid SL1, to thereby form a conveying path for guiding into the upper discharge path 521 the sheet N having been shifted by the shift unit 580 by a distance corresponding to the offset amount. The sheet N having been shifted by the shift unit 580 is discharged onto the upper discharge tray 701 via the upper discharge path 521 and is then subjected to the discharge sheet alignment process. At this time, the CPU 952 changes the speed of the discharge motor M3 after detection of passage of the trailing edge of the sheet N by the discharge sensor 574 disposed at the outlet of the upper discharge path 521, and causes the conveying roller pair 515 to rotate at a speed suitable for sheet stacking so as to discharge the sheet N onto the upper discharge tray 701.

Referring to FIG. 14, when the discharge sheet N is discharged onto the upper discharge tray 701 and the discharge sheet alignment process is started, the CPU 952 determines whether or not the discharge sensor 574 at the outlet of the upper discharge path 521 is on, and if not, waits until the discharge sensor 574 is turned on (step S201). If it is determined in the step S201 that the discharge sensor 574 is on (YES to the step S201), the CPU 952 determines whether or not the sheet N is the leading sheet of a copy (step S202). If it is determined in the step S202 that the sheet N is the leading sheet of a copy (YES to the step S202), the CPU 952 determines whether or not the alignment plate lift HP sensor 714 is on (step S203).

If it is determined in the step S203 that the alignment plate lift HP sensor 714 is on (YES to the step S203), the CPU 952 causes the alignment plates 711*a* and 711*b* of the upper discharge tray 701 to move to the lifted position which is the retracted position (step S205).

Figure 15A:
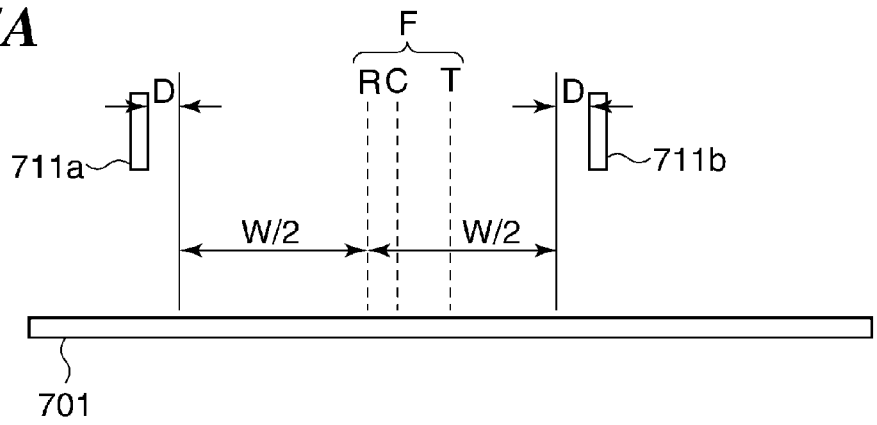
FIG. 15A is a view useful in explaining operation of the alignment plates on the upper discharge tray, which shows the lifted position of the alignment plates.
Figure 15B:
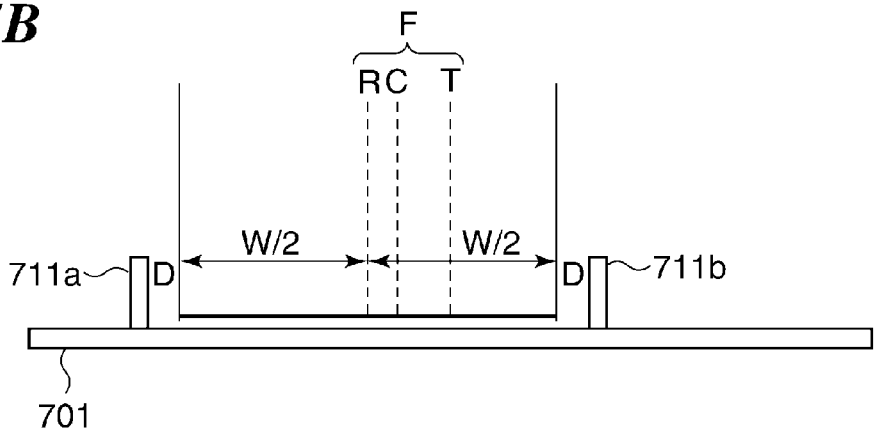
FIG. 15B is a view useful in explaining the operation of the alignment plates on the upper discharge tray, which shows the standby position of the alignment plates.
Figure 15C:
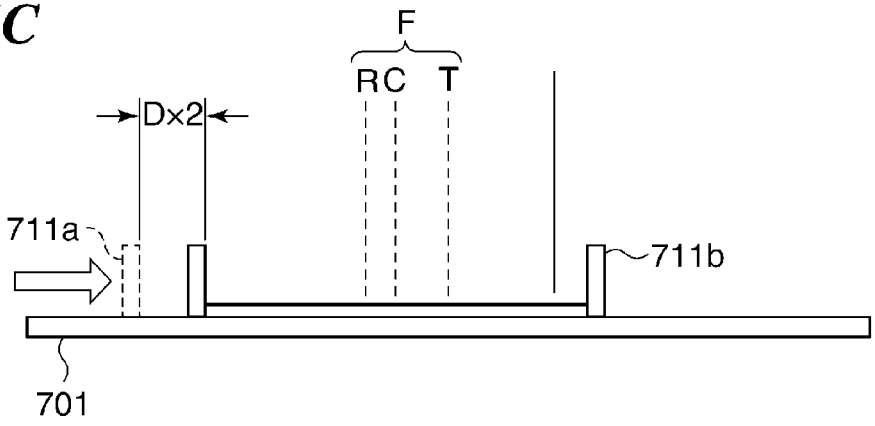
FIG. 15C is a view useful in explaining the operation of the alignment plates on the upper discharge tray, which shows the alignment position of the alignment plates.
Figure 16A:
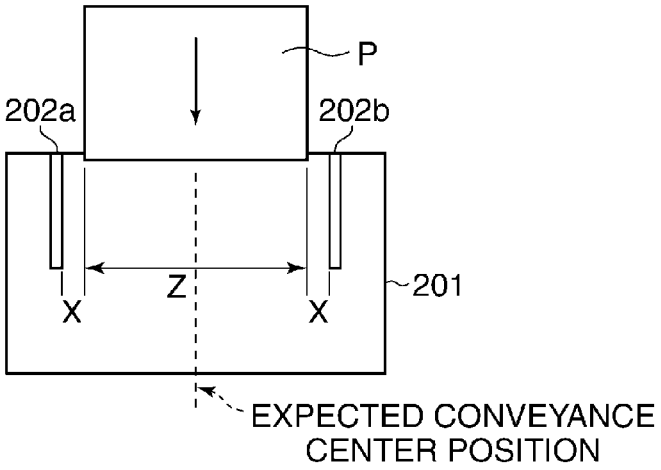
FIG. 16A is a view useful in explaining a problem with the prior art, which shows a discharge tray as viewed from above.
Figure 16B:
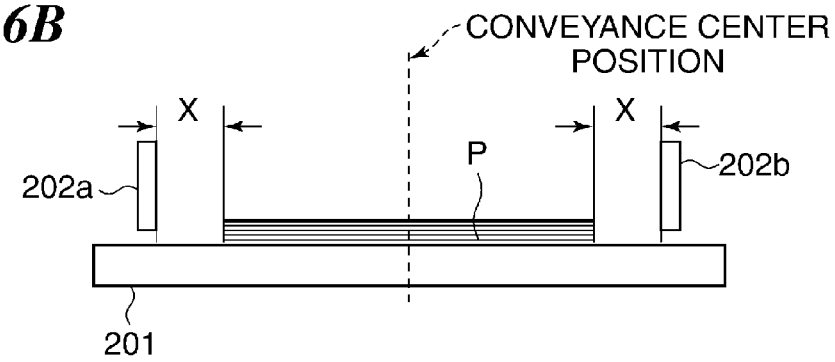
FIG. 16B is a view useful in explaining the problem with the prior art, which shows the discharge tray as viewed in a sheet discharging direction.
Figure 16C:
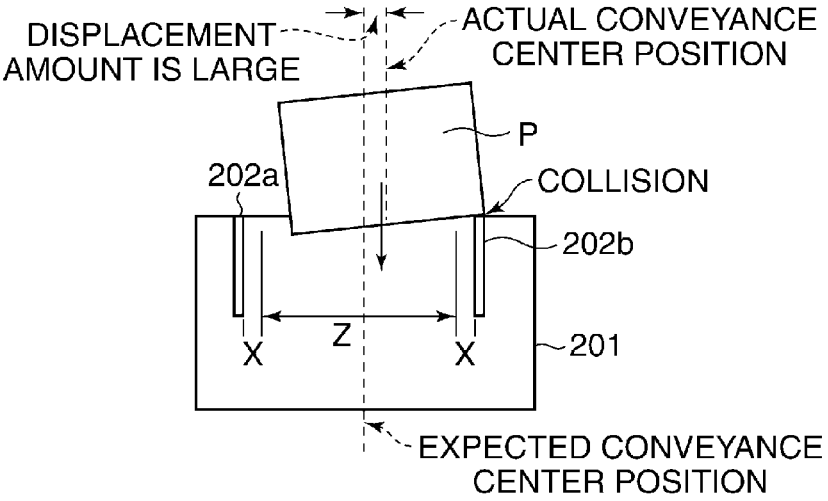
FIG. 16C is a view useful in explaining the problem with the prior art, which shows the discharge tray as viewed from above.

FIGS. 15A to 15C are views useful in explaining operation of the alignment plates on the upper discharge tray 701. FIG. 15A shows the lifted position of the alignment plates, FIG. 15B shows the standby position of the alignment plates, and FIG. 15C shows the alignment position of the alignment plates. Note that FIGS. 15A, 15B, and 15C are views of the upper discharge tray 701, as viewed in the sheet discharging direction.

In FIG. 15A, the alignment plates 711*a* and 711*b* are in the retracted position (hereinafter referred to as "the lifted position") above the upper discharge tray 701. In the state where the alignment plates 711*a* and 711*b* are in the lifted position, the CPU 952 drives the upper tray alignment motors M9 and M10 to move the alignment plates 711*a* and 711*b* to respective positions each distant from the associated sheet edge of the sheet N to be discharged, by the standby distance D in the width direction.

More specifically, in FIG. 15A, the alignment plate 711*a* is in a position spaced leftward (toward the far side), as viewed in FIG. 15A, from the center T of the upper discharge tray 701 by a distance obtained by adding the offset amount F to a half-length W/2 of a sheet width, plus the standby distance D. On the other hand, the alignment plate 711*b* is in a position spaced from the center T of the upper discharge tray 701 by a distance obtained by subtracting the offset amount F from the half-length W/2 of the sheet width, plus the standby distance D.

The standby distance D is set in the step S103 or S104 in FIG. 10 depending on whether the discharge sheet N is a lateral displacement correctable sheet or a lateral displacement uncorrectable sheet, and is stored in the RAM 954. In the present process in FIG. 14, in which the sheet N is assumed to be a lateral displacement correctable sheet, the standby distance D is set e.g. to 5 mm, and the CPU 952 sets each of the alignment plates 711*a* and 711*b* to a position spaced from the associated sheet edge of the sheet N in the ideal position e.g. by 5 mm.

Referring again to FIG. 14, after moving the alignment plates 711*a* and 711*b* to the lifted position and performing alignment between the alignment plates 711*a* and 711*b* and the respective side edges of the sheet N to be discharged (step S205), the CPU 952 proceeds to a step S206. More specifically, the CPU 952 drives the upper tray alignment plate lift motor M13 to lift down the alignment plates 711*a* and 711*b* by a predetermined distance, as shown in FIG. 15B, to the standby position (step S206). The predetermined distance corresponds to a distance required to lower the alignment plates 711*a* and 711*b* from the lifted position to the sheet placement surface, and is set e.g. to 60 mm.

Then, the CPU 952 determines whether or not the discharge sensor 574 has been turned off, and, if not, waits until the discharge sensor 574 is turned off (step S207). From the fact that after the discharge sensor 574 is turned on (step S201), it is turned off (step S207), it is known that the sheet N has been discharged onto the sheet placement surface of the upper discharge tray 701.

After the discharge sensor 574 is turned off (YES to the step S207), the CPU 952 determines whether or not a predetermined standby time period, e.g. of 50 ms for starting the alignment process has elapsed, and, if not, waits until the predetermined standby time period elapses (step S208). Then, after the lapse of the predetermined standby time period (YES to the step S208), the CPU 952 drives the upper tray alignment motor M9 to move the alignment plate 711*a* alone rightward, as viewed in FIG. 15C, by the distance D×2. As a consequence, the sheet N on the upper discharge tray 701 is pushed rightward, as viewed in FIG. 15C, and one edge of the sheet N is brought into abutment with the other alignment plate 711*b* (see FIG. 15C) (step S209). At this time, the alignment plate 711*b* is not moved, and the center C of the discharge sheet N is aligned to a position shifted leftward (toward the far side) from the center T of the upper discharge tray 701 by the distance S.

Then, the CPU 952 determines whether or not the holding time period tY has elapsed, and, if not, waits until the holding time period tY elapses (step S210). The holding time period tY is the holding time period determined in the step S105 in FIG. 10. During the holding time period, the alignment plates 711*a* and 711*b* hold the sheet N, whereby the sheet N is aligned to a predetermined position. After the lapse of the holding time period tY (YES to the step S210), the CPU 952 drives the upper tray alignment motor M9 to separate the alignment plate 711*a* from the sheet N by the distance D (step S211).

Then, the CPU 952 determines whether or not the sheet N is a copy final sheet (step S212). If it is determined in the step S212 that the sheet N is a copy final sheet (YES to the step S212), the CPU 952 drives the upper tray alignment plate lift motor M13 to move the alignment plates 711*a* and 711*b* to the lifted position (step S213), as shown in FIG. 15A. Then, the CPU 952 determines whether or not the sheet N is a last sheet (step S214). If it is determined in the step S214 that the sheet N is a last sheet (YES to the step S214), the CPU 952 terminates the present process.

On the other hand, if it is determined in the step S214 that the sheet N is not a last sheet (NO to the step S214), the CPU 952 returns to the step S201, and receives information on a next sheet. Further, if it is determined in the step S212 that the sheet N is not a copy final sheet (NO to the step S212), the CPU 952 proceeds to the step S214. Furthermore, if it is determined in the step S203 that the alignment plate lift HP sensor 715 is not on (NO to the step S203), the CPU 952 proceeds to a step S204. More specifically, the CPU 952 drives the upper tray alignment plate lift motor M13 to lift the alignment plates 711 by a predetermined distance (step S204), and then returns to the step S203. Further, it is determined in the step S202 that the sheet N is not a copy leading sheet (NO to the step S202), the CPU 952 directly proceeds to the step S206.

According to the FIG. 14 process, the standby position of the alignment plates is determined such that the distance between the alignment plates 711*a* and 711*b* is made longer in the case of alignment of a sheet N of a type that is not subjected to lateral displacement correction than in the case of alignment of a sheet N of a type that have the same width as the above-mentioned type and permits lateral displacement correction. More specifically, assuming that the position of a sheet which is discharged without lateral displacement is referred to as an ideal position, in the case of alignment of a sheet N of a type that is not subjected to lateral displacement correction, the standby distance D between the alignment plates 711*a* and 711*b* in the standby position and the respective side edges of the sheet N in the ideal position is set to be longer than in the case of alignment of a sheet N of a type that is subjected to lateral displacement correction. Then, the alignment plates 711*a* and 711*b* repeatedly perform an abutment operation, a holding operation, and a separation operation on discharged sheets N to thereby align the sheets N. Therefore, even when a discharge sheet N is a lateral displacement uncorrectable sheet, by securing a sufficient distance between the alignment plates 711*a* and 711*b*, it is possible to discharge the sheet N without bringing the sheet N into collision with the alignment plate 711*a* or 711*b*, and align the sheet N to a position shifted by the predetermined shift amount. This makes it possible to improve alignment of sheets and the quality of a sheet bundle.

In the present embodiment, when the sheet N is a lateral lift-correctable sheet, the standby distance D (first standby distance M) is set e.g. to 5 mm, while when the sheet N is a lateral lift-uncorrectable sheet, the standby distance D (second standby distance L) is set e.g. to 10 mm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-101779 filed May 19, 2015 which is hereby incorporated by reference herein in its entirety.

What is claimed is:

1. A sheet processing apparatus comprising:

a conveying unit configured to convey a sheet along a conveying path;

a detection unit provided in the conveying path and configured to detect a position of the sheet in a width direction orthogonal to a conveying direction;

a correction unit configured to correct the position of the sheet in the width direction based on a result of detection by said detection unit;

a stacking unit on which the sheet discharged via the conveying path is stacked;

an alignment unit disposed above said stacking unit and including a pair of alignment members which are movable in the width direction, said alignment unit being configured to bring said pair of alignment members into abutment with opposite edges of the sheet having been discharged to thereby align the sheet;

an acquisition unit configured to acquire a type of a sheet; and a control unit configured to, in a case where the sheet type is a type that is not subjected to correction by said correction unit, control said alignment unit such that a distance between said pair of alignment members in a standby position is set larger than that in a case where the sheet type is a type that is subjected to correction by said correction unit.

2. The sheet processing apparatus according to claim 1, wherein the correction is a lateral displacement correction.

3. The sheet processing apparatus according to claim 2, wherein when a position of a sheet which is discharged without being laterally displaced is referred to as an ideal position, in a case where the sheet is of a type that is not subjected to the lateral displacement correction, said control unit controls said alignment unit such that a distance between each alignment member in the standby position and an associated one of opposite edges of the sheet in the ideal position is longer than in a case where the sheet is of a type that is subjected to the lateral displacement correction.

4. The sheet processing apparatus according to claim 3, wherein in a case where a discharge position of the sheet is to be shifted in a predetermined direction, said correction unit offsets a position of the sheet in the width direction such that a center of the sheet in the width direction is shifted from a center of a sheet placement surface of said stacking unit in the predetermined direction by a distance corresponding to a sum of a predetermined shift amount and the aforementioned distance.

5. The sheet processing apparatus according to claim 4, wherein when the sheet is displaced in the width direction, said correction unit corrects the lateral displacement and then offsets the position of the sheet in the width direction.

6. The sheet processing apparatus according to claim 1, wherein said alignment unit includes a lift unit configured to move said alignment members between the standby position on the sheet placement surface of said stacking unit and a lifted position upward of the standby position, and wherein when a position of a sheet which is discharged without being laterally displaced is referred to as an ideal position, said control unit controls said alignment unit such that said pair of alignment members are adjusted in the lifted position such that a distance between each alignment member in the standby position and an associated one of opposite edges of the sheet in the ideal position becomes equal to a predetermined length, and is then lowered to the standby position by said lift unit, whereafter said alignment members are moved to the alignment position to align the sheet.

7. The sheet processing apparatus according to claim 1, wherein said alignment unit aligns the sheet by performing an abutment operation for bringing said pair of alignment members into abutment with the opposite edges of the sheet, respectively, a holding operation for holding the sheet by said pair of alignment members, and a separation operation for separating said pair of alignment members from the opposite edges of the sheet, respectively.

8. The sheet processing apparatus according to claim 7, wherein in the abutment operation, said alignment unit moves one of said pair of alignment members toward the other of said pair of alignment members by a distance corresponding to twice the aforementioned distance to thereby hold the sheet.

9. The sheet processing apparatus according to claim 1, wherein the sheet of the type that is not subjected to the correction by the correction unit is a sheet that passes light therethrough or a sheet whose length in the width direction is smaller than a predetermined size.

10. The sheet processing apparatus according to claim 1, wherein the sheet of the type that is not subjected to the correction by the correction unit is a translucent sheet.

11. The sheet processing apparatus according to claim 1, wherein the detection unit is an optical sensor comprised of a light emitting element and a light receiving element.

* * * * *